US011605350B2

(12) United States Patent
Jeon

(10) Patent No.: US 11,605,350 B2
(45) Date of Patent: Mar. 14, 2023

(54) DISPLAY DEVICE AND RELATED OPERATING METHOD

(71) Applicant: Samsung Display Co., Ltd., Yongin-Si (KR)

(72) Inventor: Jin Jeon, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/745,661

(22) Filed: May 16, 2022

(65) Prior Publication Data

US 2022/0277694 A1 Sep. 1, 2022

Related U.S. Application Data

(63) Continuation of application No. 16/904,499, filed on Jun. 17, 2020, now Pat. No. 11,335,267, which is a (Continued)

(30) Foreign Application Priority Data

Jan. 18, 2016 (KR) ..... 10-2016-0006086

(51) Int. Cl.
*G09G 3/3258* (2016.01)
*G09G 3/3225* (2016.01)
(Continued)

(52) U.S. Cl.
CPC ..... *G09G 3/3258* (2013.01); *G09G 3/3225* (2013.01); *G09G 3/3266* (2013.01);
(Continued)

(58) Field of Classification Search
CPC .. G09G 3/3258; G09G 3/3225; G09G 3/3266; G09G 3/3275; G09G 2300/0852;
(Continued)

(56) References Cited

U.S. PATENT DOCUMENTS 5,247,290 A 9/1993 Di Santo et al.
5,757,365 A 5/1998 Ho
(Continued)

FOREIGN PATENT DOCUMENTS

CN 102013230 A 4/2011
CN 102044214 A 5/2011
(Continued)

OTHER PUBLICATIONS

EP Search Report corresponding to European Patent Application No. 16194505.0, dated May 18, 2017, 15 pages.
(Continued)

*Primary Examiner* — Ariel A Balaoing
(74) *Attorney, Agent, or Firm* — Innovation Counsel LLP

(57) ABSTRACT

An organic light emitting display device may include a display panel, a power supply, and a display driver. The display panel may comprise a plurality of scan lines, a plurality of data lines, and a plurality of pixels connected to the scan lines and to the data lines. The power supply may supply a first pixel voltage and a second pixel voltage to the pixels. The display driver may control the display panel. The display panel may display a first image in a first frame frequency during a first driving mode, and display a second image in a second frame frequency that is lower than the first frame frequency during a second driving mode, according to a control by the display driver

28 Claims, 12 Drawing Sheets

Related U.S. Application Data continuation of application No. 16/505,653, filed on Jul. 8, 2019, now Pat. No. 10,720,108, which is a continuation of application No. 16/221,613, filed on Dec. 17, 2018, now Pat. No. 10,354,594, which is a continuation of application No. 15/237,216, filed on Aug. 15, 2016, now Pat. No. 10,186,199.

(51) Int. Cl.
*G09G 3/3266* (2016.01)
*G09G 3/3275* (2016.01)

(52) U.S. Cl.
CPC ... *G09G 3/3275* (2013.01); *G09G 2300/0852* (2013.01); *G09G 2300/0861* (2013.01); *G09G 2310/0213* (2013.01); *G09G 2310/0262* (2013.01); *G09G 2310/0278* (2013.01); *G09G 2310/0286* (2013.01); *G09G 2310/08* (2013.01); *G09G 2320/0247* (2013.01); *G09G 2330/021* (2013.01); *G09G 2330/028* (2013.01); *G09G 2340/0435* (2013.01)

(58) Field of Classification Search
CPC ..... G09G 2300/0861; G09G 2330/021; G09G 2330/028; G09G 2310/0213; G09G 2310/0262; G09G 2310/0278; G09G 2310/0286; G09G 2310/08; G09G 2340/0435
See application file for complete search history.

(56) References Cited

U.S. PATENT DOCUMENTS

| | | | | |
|---|---|---|---|---|
| 7,515,126 | B2 | 4/2009 | Senda et al. | |
| 8,698,854 | B2 | 4/2014 | Lee | |
| 8,803,562 | B2 | 8/2014 | Chung | |
| 8,902,207 | B2 | 12/2014 | Ryu et al. | |
| 9,001,108 | B2 | 4/2015 | Jang | |
| 9,165,518 | B2 | 10/2015 | Choi et al. | |
| 9,324,261 | B2 | 4/2016 | Lee | |
| 9,390,666 | B2 | 7/2016 | Oh et al. | |
| 9,437,134 | B2 | 9/2016 | Choi et al. | |
| 9,520,083 | B2 | 12/2016 | Kim | |
| 9,542,889 | B2 | 1/2017 | Lee et al. | |
| 9,548,026 | B2 | 1/2017 | Jang | |
| 9,754,535 | B2 | 9/2017 | Ohara et al. | |
| 9,966,007 | B2 | 5/2018 | Cho et al. | |
| 10,438,522 | B2 * | 10/2019 | Hur | G09G 3/3614 |
| 2002/0041281 | A1 * | 4/2002 | Yanagi | G09G 3/3655 345/212 |
| 2003/0174153 | A1 | 9/2003 | Koyama | |
| 2004/0095364 | A1 | 5/2004 | Koyama et al. | |
| 2008/0012818 | A1 | 1/2008 | Lee et al. | |
| 2008/0024480 | A1 | 1/2008 | Jee et al. | |
| 2008/0068359 | A1 * | 3/2008 | Yoshida | G09G 3/3406 345/204 |
| 2008/0225062 | A1 | 9/2008 | Chang et al. | |
| 2011/0057917 | A1 | 3/2011 | Ryu et al. | |
| 2011/0084958 | A1 | 4/2011 | Choi et al. | |
| 2011/0292008 | A1 | 12/2011 | Iwabuchi et al. | |
| 2012/0069059 | A1 | 3/2012 | Lee | |
| 2013/0082910 | A1 | 4/2013 | Lee | |
| 2014/0192103 | A1 | 7/2014 | Ha | |
| 2014/0292835 | A1 * | 10/2014 | Matsushima | G09G 3/3648 345/87 |
| 2014/0368490 | A1 | 12/2014 | Yokonuma et al. | |
| 2015/0062099 | A1 * | 3/2015 | Jeon | G09G 3/2096 345/204 |
| 2015/0062100 | A1 * | 3/2015 | Tanaka | G09G 3/3648 345/204 |
| 2015/0187334 | A1 | 7/2015 | Oh et al. | |
| 2015/0194121 | A1 | 7/2015 | Lee et al. | |
| 2016/0005346 | A1 | 1/2016 | Kim | |
| 2016/0343305 | A1 | 11/2016 | Kamyamaguchi et al. | |
| 2017/0154567 | A1 | 6/2017 | Ko et al. | |

FOREIGN PATENT DOCUMENTS

| | | | |
|---|---|---|---|
| CN | 102411898 | A | 4/2012 |
| CN | 102930839 | A | 2/2013 |
| CN | 103035174 | A | 4/2013 |
| CN | 103632633 | A | 3/2014 |
| CN | 104766571 | A | 7/2015 |
| CN | 104952396 | A | 9/2015 |
| CN | 105074808 | A | 11/2015 |
| CN | 105096836 | A | 11/2015 |
| CN | 106328056 | A | 1/2017 |
| EP | 2701142 | A2 | 2/2014 |
| EP | 3113165 | A1 | 1/2017 |
| KR | 10-2011-0038915 | A | 4/2011 |
| KR | 10-2013-0092814 | A | 8/2013 |
| KR | 10-2014-0025149 | A | 3/2014 |
| KR | 10-2014-0143593 | A | 12/2014 |
| KR | 10-2015-0077807 | A | 7/2015 |
| KR | 10-2015-0082901 | A | 7/2015 |

OTHER PUBLICATIONS

EP Search Report corresponding to European Patent Application No. 16194505.0, dated Sep. 28, 2017, 32 pages.

* cited by examiner

DISPLAY DEVICE AND RELATED OPERATING METHOD

CROSS-REFERENCE TO RELATED APPLICATIONS

This application is a continuation application of U.S. patent application Ser. No. 16/904,499 filed on Jun. 17, 2020, which is a continuation application of U.S. patent application Ser. No. 16/505,653 filed on Jul. 8, 2019 (U.S. Pat. No. 10,720,108), which is a continuation application of U.S. patent application Ser. No. 16/221,613 filed on Dec. 17, 2018 (U.S. Pat. No. 10,354,594), which is a continuation application of U.S. patent application Ser. No. 15/237,216 filed on Aug. 15, 2016 (U.S. Pat. No. 10,186,199), which claims priority to Korean Patent Application No. 10-2016-0006086 filed on Jan. 18, 2016 in the Korean Intellectual Property Office; the prior applications are incorporated by reference.

BACKGROUND

Field

The technical field relates to a display device, e.g., an organic light emitting display device, and a method of operating the display device.

Description of the Related Art

A display device may operate to display images, such as motion pictures and still images. An organic light emitting display device is a device that displays images using organic light emitting diodes that generate light through recombination of electrons and holes. Such devices have advantageous effects of fast response speed and ability to display clear images.

Generally, an organic light emitting display device includes a plurality of pixels that can emit light in certain colors, a scan driver that supplies scan signals to the pixels, and a data driver that synchronizes data signals with the scan signals and supplies the synchronized data signals to the pixels.

SUMMARY

Embodiments may be related to a display device, e.g., an organic light emitting display device, capable of operating with satisfactorily low power consumption.

According to an embodiment, an organic light emitting display device may include the following elements: a display panel that includes a plurality of scan lines, a plurality of data lines, and a plurality of pixels connected to the scan lines and to the data lines; a power supply for supplying a first pixel voltage and a second pixel voltage to the pixels; and a display driver configured to control the display panel, wherein the display panel displays a first image in a first frame frequency during a first driving mode (or first display mode), and displays a second image in a second frame frequency that is lower than the first frame frequency during a second driving mode (or second display mode), according to a control by the display driver.

The display driver may further include a scan driver configured to supply scan signals to the pixels through the scan lines; a data driver configured to supply data signals to the pixels through the data lines; and a timing controller configured to control the scan driver and the data driver.

A plurality of frame periods (or frame-length periods) that proceed during (and/or correspond to) the second driving mode may include at least one supply frame period (or supply period) and a hold period that includes a plurality of remaining frame periods (or frame-length periods remaining in the second driving mode), and the scan driver may supply the scan signals to the scan lines during the supply frame period, and stop supplying the scan signals during the remaining frame periods.

The data driver may supply the data signals to the data lines during the supply frame period, and stop supplying the data signals during the remaining frame periods.

The scan driver may supply the scan signals to the scan lines at every frame period that proceeds during (and/or correspond to) the first driving mode, and the data driver may supply the data signals to the data lines at every frame period that proceeds during the first driving mode.

The power supply may supply a first driving voltage and a second driving voltage to the scan driver.

The power supply may adjust at least one level of the first pixel voltage and the second pixel voltage such that a voltage difference between the first pixel voltage and the second pixel voltage during the second driving mode is smaller than a voltage difference between the first pixel voltage and the second pixel voltage during the first driving mode.

The organic light emitting display device may further include a first pixel power line and a second pixel power line for transmitting the first pixel voltage and the second pixel voltage to the pixels, and the pixels may include an organic light emitting diode and a driving transistor connected between the first pixel power line and the second pixel power line.

The driving transistor may operate in a saturation region during the first driving mode, and operate in a linear region during the second driving mode.

The timing controller may supply a first scan driving signal and a second scan driving signal to the scan driver, and the scan driver may output the scan signals in response to the first scan driving signal and the second scan driving signal.

The first scan driving signal may be set to a first clock signal during the supply frame period, and be maintained at a constant voltage level during the remaining frame period, and the second scan driving signal may be set to a second clock signal during the supply frame period, and be maintained at a constant voltage level during the remaining frame period.

The voltage level of the first scan driving signal being supplied during the remaining frame period may be the same as a low level voltage of the first clock signal, and the voltage level of the second scan driving signal being supplied during the remaining frame period may be the same as a low level voltage of the second clock signal.

The scan driver may include a plurality of stage circuits connected to the scan lines, and each of the stage circuits may include a first transistor connected between a third input terminal and a first node, and including a gate electrode connected to a first input terminal; a second transistor connected between a second node and a first voltage terminal for receiving the first driving voltage, and including a gate electrode connected to a third node; a third transistor connected between the first node and the second node, and including a gate electrode connected to a second input terminal; a fourth transistor connected between the third node and the first input terminal, and including a gate electrode connected to the first node; a fifth transistor connected between the third node and a second voltage terminal for receiving the second driving voltage, and including a gate electrode connected to the first input terminal; a sixth transistor connected between the first voltage terminal and an output terminal, and including a gate electrode connected to the third node; and a seventh transistor connected between the output terminal and the second input terminal, and including a gate electrode connected to the first node.

Each of the stage circuits may further include a first capacitor connected between the first node and the output terminal; and a second capacitor connected between the first voltage terminal and the third node.

A third input terminal of a first stage circuit of the stage circuits may receive an initial signal from the timing controller, and a third input terminal of a $j^{th}$ (j being a natural number of 2 or above) of the stage circuits may be connected to an output terminal of a $j-1^{th}$ stage circuit.

A first input terminal and a second input terminal of each of odd-numbered stage circuits of the stage circuits may receive the first scan driving signal and the second scan driving signal, respectively, and a first input terminal and a second input terminal of each of even-numbered stage circuits of the stage circuits may receive the second scan driving signal and the first scan driving signal, respectively.

The power supply may adjust at least one level of the first driving voltage and the second driving voltage such that a voltage difference between the first driving voltage and the second driving voltage during the second driving mode is smaller than a voltage difference between the first driving voltage and the second driving voltage during the first driving mode.

The display panel may further include a plurality of emission control lines connected to the pixels, and the display driver may further include a emission control driver configured to supply emission control signals to the pixels through the emission control lines, to supply the emission control signals to the emission control lines during the supply frame period, and to stop the supply of the emission control signals during the remaining frame periods.

The emission control driver may supply the emission control signals to the emission control lines at every frame period that proceeds during the first driving mode.

The timing controller may supply a first emission driving signal and a second emission driving signal to the emission control driver, and the emission control driver may output the emission control signals in response to the first emission driving signal and the second emission driving signal.

The first emission driving signal may be set to a third clock signal during the supply frame period, and be maintained at a constant voltage level during the remaining frame periods, and the second emission driving signal may be set to a fourth clock signal during the supply frame period, and be maintained at a constant voltage level during the remaining frame periods.

The voltage level of the first emission control signal being supplied during the remaining frame periods may be the same as a high level voltage of the third clock signal, and the voltage level of the second emission control signal being supplied during the remaining frame periods may be the same as a high level voltage of the fourth clock signal.

The emission control driver may include a plurality of stage circuits connected to the emission control lines, and each of the stage circuits may include a first transistor connected between a third input terminal and a first node, and including a gate electrode connected to a first input terminal; a second transistor connected between a second node and a first input terminal, and including a gate electrode connected to the first node; a third transistor connected between the second node and a second voltage terminal, and including a gate electrode connected to the first input terminal; a fourth transistor connected between the first node and a third node, and including a gate electrode connected a second input terminal; a fifth transistor connected between a first voltage terminal and the third node, including a gate electrode connected to the second node; a sixth transistor connected between a fourth node and the second input terminal, and including a gate electrode connected to the second node; a seventh transistor connected between the fourth node and a fifth node, and including a gate electrode connected to the second input terminal; an eighth transistor connected between the first voltage terminal and the fifth node, and including a gate electrode connected to the first node; a ninth transistor connected between the first voltage terminal and an output terminal, and including a gate electrode connected to the fifth node; and a tenth transistor connected between the output terminal and the second voltage terminal, and including a gate electrode connected to the first node.

Each of the stage circuits may further include a first capacitor connected between the first node and the second input terminal; a second capacitor connected between the second node and the fourth node; and a third capacitor connected between the first voltage terminal and the fifth node.

A third input terminal of a first stage circuit of the stage circuits may receive an initial signal from the timing controller, and a third input terminal of a $K^{th}$ (K being a natural number of 2 or above) of the stage circuits may be connected to an output terminal of a $K-1^{th}$ stage circuit.

A first input terminal and a second input terminal of each of odd-numbered stage circuits of the stage circuits may receive the first emission driving signal and the second emission driving signal, respectively, and a first input terminal and a second input terminal of each of even-numbered stage circuits of the stage circuits may receive the second emission driving signal and the first emission driving signal, respectively.

According to an embodiment, a method for driving an organic light emitting display device may include the following steps: performing a first driving mode that involves displaying an image on a display panel that includes a plurality of pixels in a first frame frequency; and performing a second driving mode that involves displaying an image on the display panel in a second frame frequency that is lower than the first frame frequency.

At the performing a first driving mode, the pixels may be supplied with scan signals and data signals at every frame period; and at the performing a second driving mode, the pixels may be supplied with scan signals and data signals during a portion of a frame period, and are not supplied with the scan signals and the data signals during the remaining frame periods.

At the performing a first driving mode and at the performing a second driving mode, the pixels may be supplied with a first pixel voltage and a second pixel voltage, and a voltage difference between the first pixel voltage and the second pixel voltage during the second driving mode may be smaller than a voltage difference between the first pixel voltage and the second pixel voltage during the first driving mode.

The pixels may include an organic light emitting diode and a driving transistor connected between a first pixel power line for receiving the first pixel voltage and a second pixel power line for receiving the second pixel voltage, and the driving transistor may operate in a saturation region during the first driving mode, and operate in a linear region during the second driving mode.

According to embodiments, by conserving control signals and/or applying relatively small voltage differences during the supply period and during the hold period, a display device (e.g., an organic light emitting display device) may operate with satisfactorily low power consumption.

According to embodiments, a display device (e.g., an organic light emitting display device) may display images with satisfactory quality.

DETAILED DESCRIPTION

Figure 1:
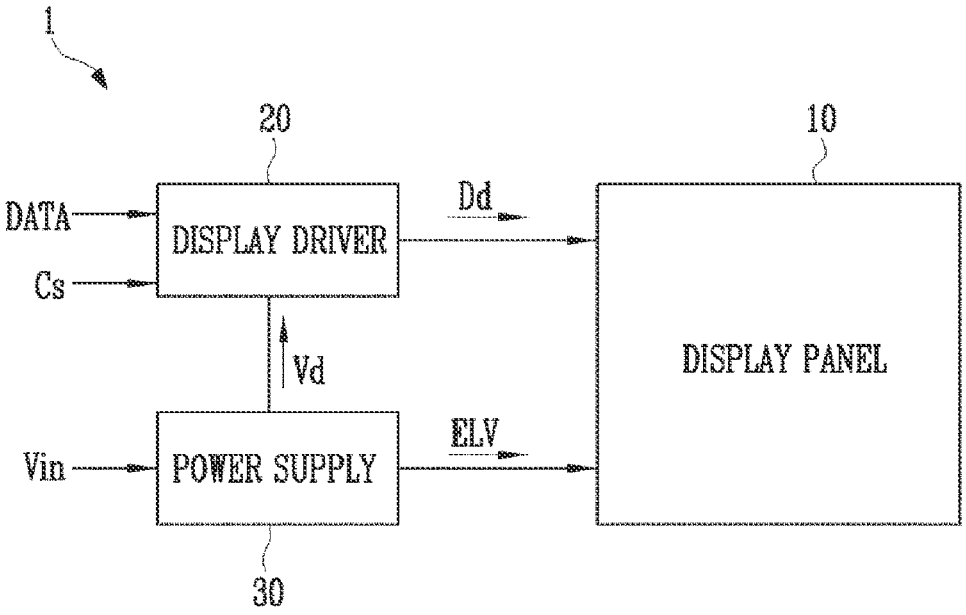
FIG. 1 is a view (e.g., a block diagram) illustrating elements of a display device, e.g., an organic light emitting display device, according to an embodiment.

Although embodiments are shown and described for purposes of illustration, those of ordinary skill in the art would understand that the described embodiments may be modified in various ways without departing from the spirit or scope of the embodiments. The drawings and description are illustrative in nature and not restrictive. When an element is referred to as being "connected to" another element, it may be directly connected to the other element, or it may be indirectly connected to the other element through one or more intervening elements. Like reference numerals refer to like elements. In the drawings, the thickness or size of layers may be exaggerated for clarity and not necessarily drawn to scale.

Although the terms "first", "second", etc. may be used herein to describe various elements, these elements should not be limited by these terms. These terms may be used to distinguish one element from another element. Thus, a first element discussed in this application may be termed a second element without departing from embodiments. The description of an element as a "first" element may not require or imply the presence of a second element or other elements. The terms "first", "second", etc. may also be used herein to differentiate different categories or sets of elements. For conciseness, the terms "first", "second", etc. may represent "first-category (or first-set)", "second-category (or second-set)", etc., respectively.

If a first element (such as a layer, film, region, or substrate) is referred to as being "on", "neighboring", "connected to", or "coupled with" a second element, then the first element can be directly on, directly neighboring, directly connected to, or directly coupled with the second element, or an intervening element may also be present between the first element and the second element. If a first element is referred to as being "directly on", "directly neighboring", "directly connected to", or "directed coupled with" a second element, then no intended intervening element (except environmental elements such as air) may be provided between the first element and the second element.

Spatially relative terms, such as "beneath", "below", "lower", "above", "upper", and the like, may be used herein for ease of description to describe one element or feature's spatial relationship to another element(s) or feature(s) as illustrated in the figures. It will be understood that the spatially relative terms may encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations), and the spatially relative descriptors used herein should be interpreted accordingly.

The terminology used herein is for the purpose of describing particular embodiments and is not intended to limit the embodiments. As used herein, the singular forms, "a", "an", and "the" may indicate plural forms as well, unless the context clearly indicates otherwise. The terms "includes" and/or "including", when used in this specification, may specify the presence of stated features, integers, steps, operations, elements, and/or components, but may not preclude the presence or addition of one or more other features, integers, steps, operations, elements, components, and/or groups.

Unless otherwise defined, terms (including technical and scientific terms) used herein have the same meanings as commonly understood by one of ordinary skill in the art. Terms, such as those defined in commonly used dictionaries, should be interpreted as having meanings that are consistent with their meanings in the context of the relevant art and should not be interpreted in an idealized or overly formal sense unless expressly so defined herein.

The term "connect" may mean "electrically connect", "directly connect", or "indirectly connect". The term "insulate" may mean "electrically insulate". The term "conductive" may mean "electrically conductive". The term "electrically connected" may mean "electrically connected without any intervening transistors". If a component (e.g., a transistor) is described as connected between a first element and a second element, then a source/drain/input/output terminal of the component may be electrically connected to the first element through no intervening transistors, and a drain/source/output/input terminal of the component may be electrically connected to the second element through no intervening transistors.

The term "conductor" may mean "electrically conductive member". The term "insulator" may mean "electrically insulating member". The term "dielectric" may mean "dielectric member". The term "interconnect" may mean "interconnecting member". The term "provide" may mean "provide and/or form". The term "form" may mean "provide and/or form".

Unless explicitly described to the contrary, the word "comprise" and variations such as "comprises", "comprising", "include", or "including" may imply the inclusion of stated elements but not the exclusion of other elements.

Various embodiments, including methods and techniques, are described in this disclosure. Embodiments may also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, embodiments may also cover apparatuses for practicing embodiments. Such apparatus may include circuits, dedicated and/or programmable, to carry out operations pertaining to embodiments. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments.

FIG. 1 is a view illustrating a display device 1, e.g., an organic light emitting display device 1, according to an embodiment.

Referring to FIG. 1, the display device 1 may include a display panel 10, a display driver 20, and a power supply 30.

The display panel 10 includes a plurality of pixels, and may thus display a predetermined image.

For example, the display panel 10 may display an image according to a control by the display driver 20.

Furthermore, the display panel 10 may be realized as an organic light emitting display panel where each pixel includes an organic light emitting diode.

Explanation will be made on the display panel 10 in more detail later on with reference to FIG. 3.

The display driver 20 may control an image display operation of the display panel 10 by supplying a driving signal Dd to the display panel 10.

For example, the display driver 20 may set different frame frequencies for different driving modes, and control the display panel 10 to display the image according to the different frame frequency set for different driving modes.

The display driver 20 may generate the driving signal Dd using image data DATA and a control signal Cs being supplied from outside.

For example, the display driver 20 may receive the image data DATA and the control signal Cs from a host (not illustrated). Herein, examples of the control signal Cs include a vertical synchronization signal, a horizontal synchronization signal, a main clock signal and the like.

Herein, examples of the driving signal Dd include a scan signal, an emission control signal, a data signal generated using the image data DATA and the like.

For example, the display driver 20 may be connected to the display panel 10 through an additional component (for example, a circuit board).

In an embodiment, the display driver 20 may be arranged directly inside the display panel 10.

Explanation on the display driver 20 will be made in more detail later on with reference to FIG. 3.

The power supply 30 may supply a voltage ELV necessary for driving the display panel 10 to the display panel 10, and/or supply a voltage Vd necessary for driving the display driver 20 to the display driver 20.

For example, the power supply 30 may generate the voltages ELV and Vd necessary for driving the display panel 10 and the display driver 20 by converting a voltage Vin being input from outside into voltages suitable to specifications of the display panel 10 and the display driver 20, respectively.

The input voltage Vin may be supplied from a battery (not illustrated) or a rectifying device and the like.

For example, the power supply 30 may set the level of the output voltages ELV and Vd differently depending on the driving mode in order to reduce power consumption.

Figure 2A:
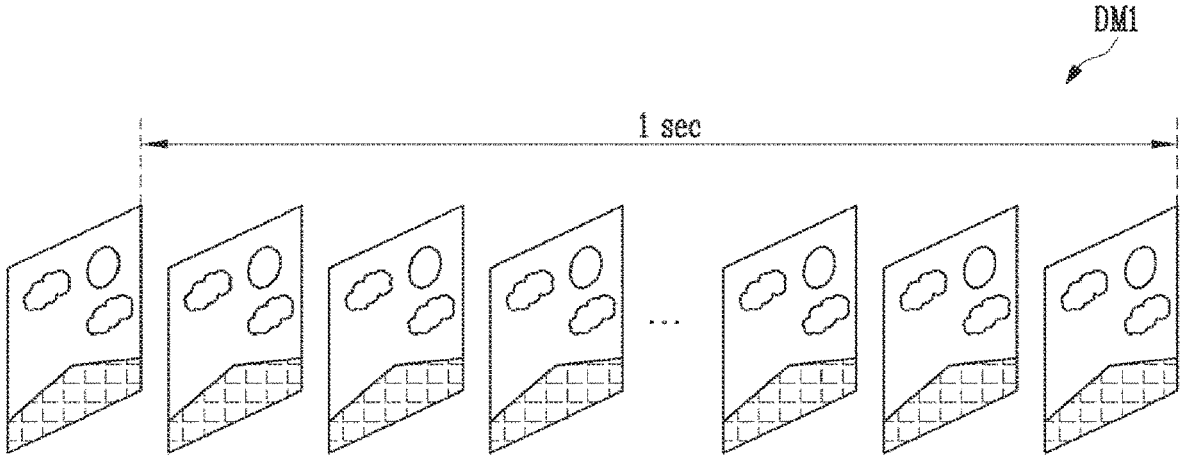
FIG. 2A and FIG. 2B are views illustrating a method for driving the display device in different driving modes according to an embodiment.
Figure 2B:
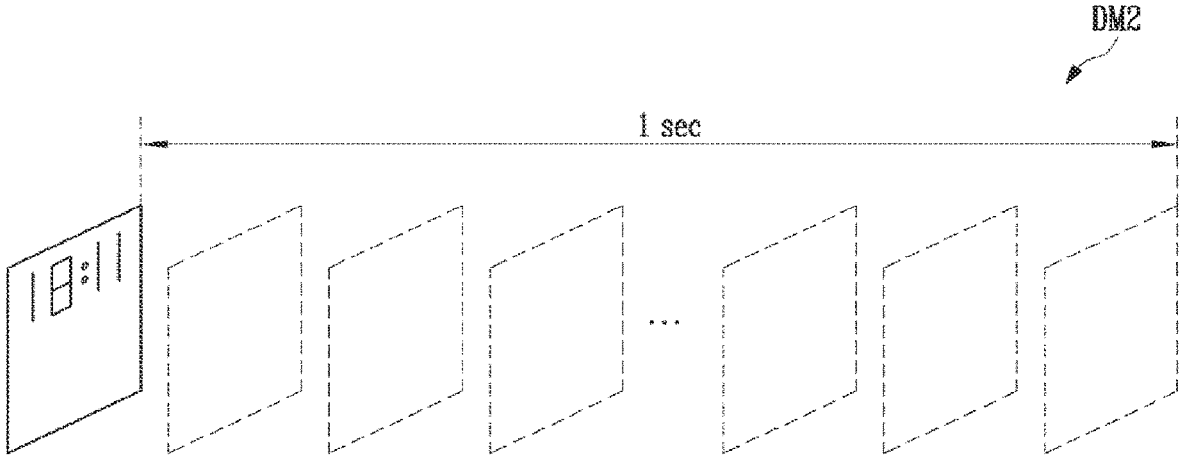

FIGS. 2A and 2B are views illustrating a method for driving the display device 1 (e.g., the organic light emitting display device 1) according to an embodiment.

Especially, FIG. 2A illustrates image display operations of the display panel 10 in a first driving mode DM1, while FIG. 2B illustrates image display operations of the display panel 10 in a second driving mode DM2.

The organic light emitting display device 1 may operate differently for the first driving mode DM1 and the second driving mode DM2.

The first driving mode DM1 is a mode for display a normal image. An entirety of a display area of the display panel 10 may be used to provide various types of images to a user in this mode.

The first driving mode DM1 may be referred to as a normal driving mode.

The second driving mode DM2 is a mode for displaying a waiting image and/or a stationary image. The waiting image may be displayed on a portion of a display area of the display panel 10.

For example, the waiting image may display a simplified piece of information. The waiting image may include information such as data, time, weather and the like, and further, numbers, texts, figures, icons and the like used to express certain information as well.

The second driving mode DM2 may be referred to as a waiting driving mode.

The organic light emitting display device 1 may enter into the first driving mode DM1 or the second driving mode DM2 at a user's request, for example.

Furthermore, if there is no user input for a certain period of time while in the first driving mode DM1, a conversion may be made to the second driving mode DM2.

It is possible to modify entering conditions for each driving mode DM1 and DM2, and conditions for conversion between the driving modes DM1 and DM2 in various ways.

Referring to FIG. 2A, the display panel 10 may display an image in a first frame frequency during the first driving mode DM1.

For example, the display driver 20 may identify a current driving mode based on the signal being input from outside, and if it is identified that the current driving mode is the first driving mode DM1, the display driver 20 may control the display panel 10 to display the image in the first frame frequency.

For example, in the case where the first frame frequency is set to 60 Hz, the display panel 10 may display sixty (60) frames for every second.

For this purpose, the display driver 20 may operate at every sixty (60) frame period that proceeds in one (1) second.

However, the first frame frequency is not limited to 60 Hz. It is possible to modify the first frame frequency to various frequencies such as 10 Hz, 30 Hz, 120 Hz, 240 Hz and the like.

Referring to FIG. 2B, the display panel 10 may display the image in a second frame frequency during the second driving mode DM2.

For example, the display driver 20 may identify the current driving mode based on the signal being input from outside, and if it is identified that the current driving mode is the second driving mode DM2, the display driver 20 may control the display panel 10 to display the image in the second frame frequency.

Since only a relatively simple waiting image needs to be displayed in the second driving mode DM2, it is necessary to operate the organic light emitting display device 1 in a low frequency in order to reduce power consumption.

Therefore, the second frame frequency may be set to be lower than the first frame frequency.

For example, in the case where the first frame frequency is set to 60 Hz, it is possible to set the second frame frequency to 1 Hz, in which case the display panel 10 may display one (1) frame for each second.

For this purpose, the display driver 20 may enable new image frames only during a certain frame period (for example, a first frame period) of the sixty (60) frame periods that proceed during one (1) second, and display a corresponding frame.

During the rest of the frame periods (for example, from a second frame period to a sixtieth frame period) of the sixty (60) frame periods, the display driver 20 is either stopped or minimized, and thus the power consumption may be reduced.

The second frame frequency is not limited to 1 Hz. It is possible to modify the second frame frequency to various frequencies such as 2 Hz, 3 Hz and the like as long as the second frame frequency is lower than the first frame frequency.

Figure 3:
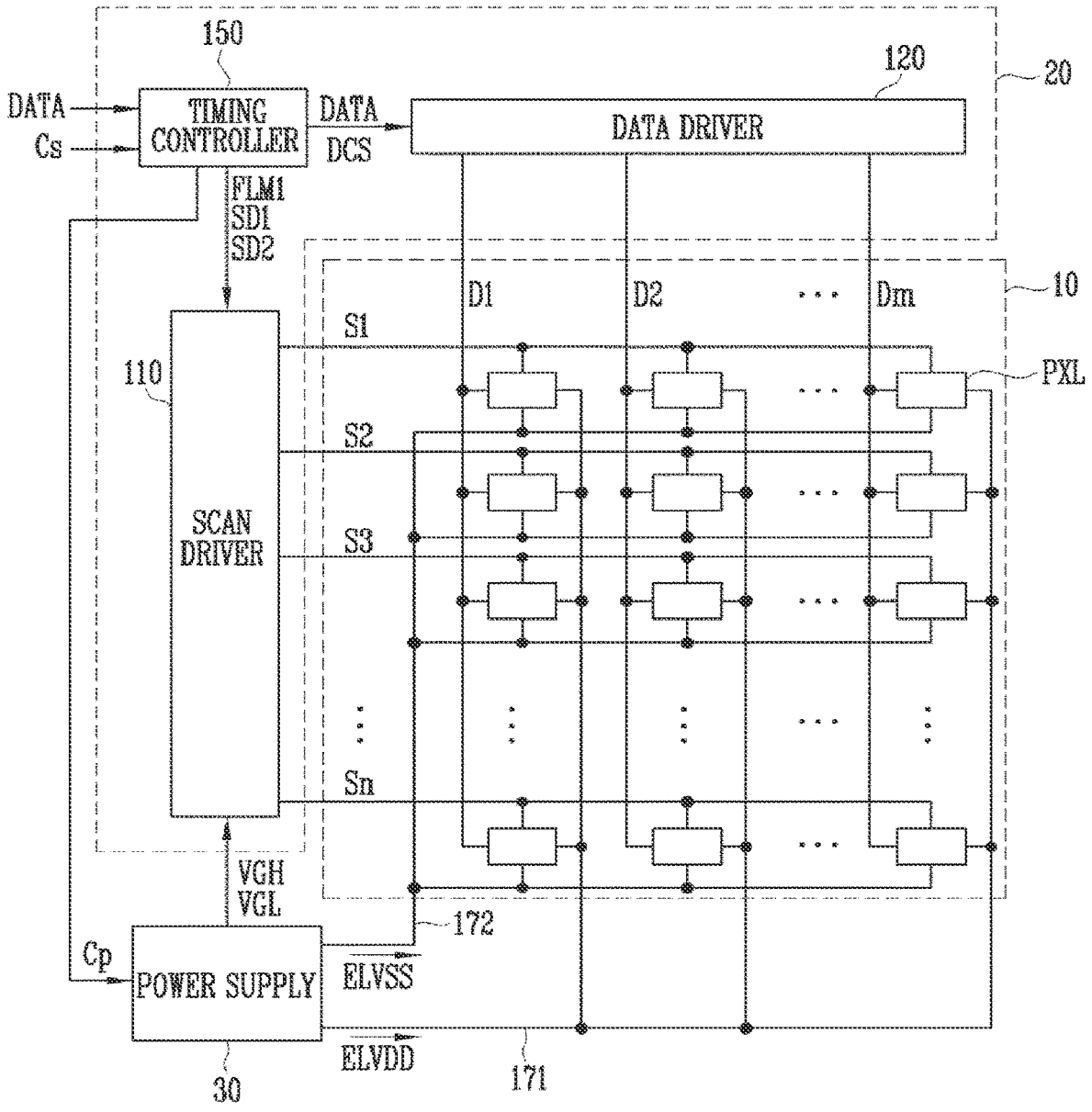
FIG. 3 is a view illustrating a display panel, a display driver, and a power supply according to an embodiment.

FIG. 3 is a view illustrating the display panel, the display driver, and the power supply according to an embodiment.

Referring to FIG. 3, the display panel according to an embodiment may include a plurality of data lines D1 to Dm, a plurality of scan lines S1 to Sn, and a plurality of pixels PXL.

The pixels PXL may be connected with the data lines D1 to Dm and the scan lines S1 to Sn.

Furthermore, the pixels PXL may be supplied with a data signal and a scan signal through the data lines D1 to Dm and the scan lines S1 to Sn.

The data lines D1 to Dm may be connected between a data driver 120 and the pixels PXL, and the scan lines S1 to Sn may be connected between a scan driver 110 and the pixels PXL.

The pixels PXL may be supplied with a first pixel voltage ELVDD and a second pixel voltage ELVSS from the power supply 30.

The display driver 20 may include the scan driver 110, the data driver 120, and a timing controller 150.

The scan driver 110 may generate a scan signal according to a control by the timing controller 150, and supply the generated scan signal to the scan lines S1 to Sn.

Therefore, each of the pixels PXL may be supplied with the scan signal through the scan lines S1 to Sn.

For example, the scan driver 110 may receive a first initial signal FLM1, a first scan driving signal SD1, and a second scan driving signal SD2 from the timing controller 150, and operate accordingly.

The data driver 120 may generate a data signal according to a control by the timing controller 150, and supply the generated data signal to the data lines D1 to Dm.

Therefore, the pixels PXL may be supplied with the data signal through the data lines D1 to Dm.

For example, the data driver 120 may receive image data DATA and a data driver control signal DCS from the timing controller 150, and generate a data signal accordingly.

Furthermore, the data driver 120 may synchronize the generated data signal with a scan signal of the scan driver 110, and supply the synchronized signal to each pixel PXL.

The power supply 30 may supply the first pixel voltage ELVDD and the second pixel voltage ELVSS to the pixels PXL.

A first pixel power line 171 and a second pixel power line 172 may be connected between the pixels PXL and the power supply 30.

Therefore, the power supply 30 may supply the first pixel voltage ELVDD and the second pixel voltage ELVSS to each pixel PXL through the first pixel power line 171 and the second pixel power line 172.

The first pixel voltage ELVDD and the second pixel voltage ELVSS may be set to voltages different from each other.

For example, the first pixel voltage ELVDD may be set to a positive voltage while the second pixel voltage ELVSS is set to a negative voltage or a ground voltage.

The power supply 30 may supply a first driving voltage VGH and a second driving voltage VGL to the scan driver 110.

The first driving voltage VGH and the second driving voltage VGL may be set to voltages different from each other.

For example, the first driving voltage VGH may be set to a positive voltage that is higher than the first pixel voltage ELVDD, while the second driving voltage VGL is set to a negative voltage that is lower than the second pixel voltage ELVSS.

The timing controller 150 may control the scan driver 110, the data driver 120, and the power supply 30.

For example, the timing controller 150 may control operations of the scan driver 110 by generating the first initial signal FLM1, the first scan driving signal SD1, and the second scan driving signal SD2 using the control signal Cs being supplied from outside, and then supplying the generated first initial signal FLM1, the first scan driving signal SD1, and the second scan driving signal SD2 to the scan driver 110.

The timing controller 150 may convert the image data DATA being supplied from outside into image data that is suitable to the specifications of the data driver 120, and supply the converted image data to the data driver 120.

Furthermore, the timing controller 150 may control operations of the data driver 120 by generating the data driver control signal DCS using the control signal Cs being supplied from outside, and then supplying the generated data driver control signal DCS to the data driver 120.

Figure 4:
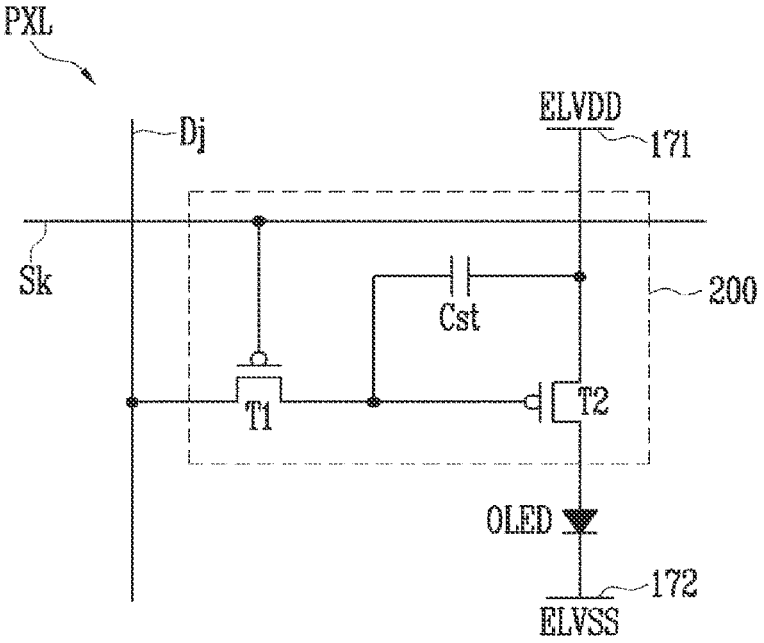
FIG. 4 is a view illustrating an example of a pixel illustrated in FIG. 3.

FIG. 4 is a view illustrating an embodiment of the pixel illustrated in FIG. 3. Especially, for convenience sake, FIG. 4 illustrates a pixel PXL connected to a $k^{th}$ scan line Sk and a $j^{th}$ data line Dj.

Referring to FIG. 4, the pixel PXL is equipped with an organic light emitting diode (OLED), and a pixel circuit 200 connected to the $j^{th}$ data line Dj and the $k^{th}$ scan line Sk to control the organic light emitting diode (OLED).

An anode electrode of the organic light emitting diode (OLED) may be connected to the pixel circuit 200, and a cathode electrode of the organic light emitting diode (OLED) may be connected to the second pixel power line 172.

It is possible for such an organic light emitting diode (OLED) to generate light of a predetermined brightness in response to a current being supplied from the pixel circuit 200.

When a scan signal is being supplied to the $k^{th}$ scan line Sk, the pixel circuit 200 may store the data signal being supplied to the $j^{th}$ data line Dj, and control an amount of current being supplied to the organic light emitting diode (OLED) in response to the stored data signal.

For example, the pixel circuit 200 may include a first pixel transistor T1, a second pixel transistor T2, and a storage capacitor Cst.

The first pixel transistor T1 may be connected between the $j^{th}$ data line Dj and the second pixel transistor T2.

For example, a gate electrode of the first pixel transistor T1 may be connected to the $k^{th}$ scan line Sk, and a first electrode of the first pixel transistor T1 may be connected to the $j^{th}$ data line Dj, and a second electrode of the first pixel transistor T1 may be connected to a gate electrode of the second pixel transistor T2.

When the scan signal is supplied from the kth scan line Sk, the first pixel transistor T1 is turned-on, and then the first pixel transistor T1 may supply the data signal received from the jth data line Dj to the storage capacitor Cst.

At this time, the storage capacitor Cst may be charged with a voltage corresponding to the data signal.

The second pixel transistor T2 may be connected between the first pixel power line 171 and the organic light emitting diode (OLED).

For example, a gate electrode of the second pixel transistor T2 may be connected to a first electrode of the storage capacitor Cst and to a second electrode of the first pixel transistor T1, a first electrode of the second pixel transistor T2 may be connected to a second electrode of the storage capacitor Cst and to the first pixel power line 171, and a second electrode of the second pixel transistor T2 may be connected to the anode electrode of the organic light emitting diode (OLED).

Such a second pixel transistor T2 is a driving transistor, and thus it is possible for such a second pixel transistor T2 to control an amount of current that is flowing from the first pixel power line 171 to the second pixel power line 172 via the organic light emitting diode (OLED), in response to the voltage value stored in the storage capacitor Cst.

At this time, the organic light emitting diode (OLED) may generate light corresponding to the amount of current being supplied to the second pixel transistor T2.

Herein, either one of the source electrode and the drain electrode of each of the pixel transistors T1 and T2 may be set as the first electrode, and the remaining other of the source electrode and the drain electrode may be set as the second electrode. For example, when the source electrode is set as the first electrode, the drain electrode may be set as the second electrode.

Furthermore, each of the pixel transistors T1 and T2 may be realized as a PMOS transistor.

The pixel structure of FIG. 4 explained hereinabove is a mere embodiment. The pixel PXL is not limited to the aforementioned structure. In fact, the pixel circuit 200 may have a circuit structure where a current may be supplied to the organic light emitting diode (OLED), and a pixel structure may be selected from various well known structures in the related field.

Figure 5:
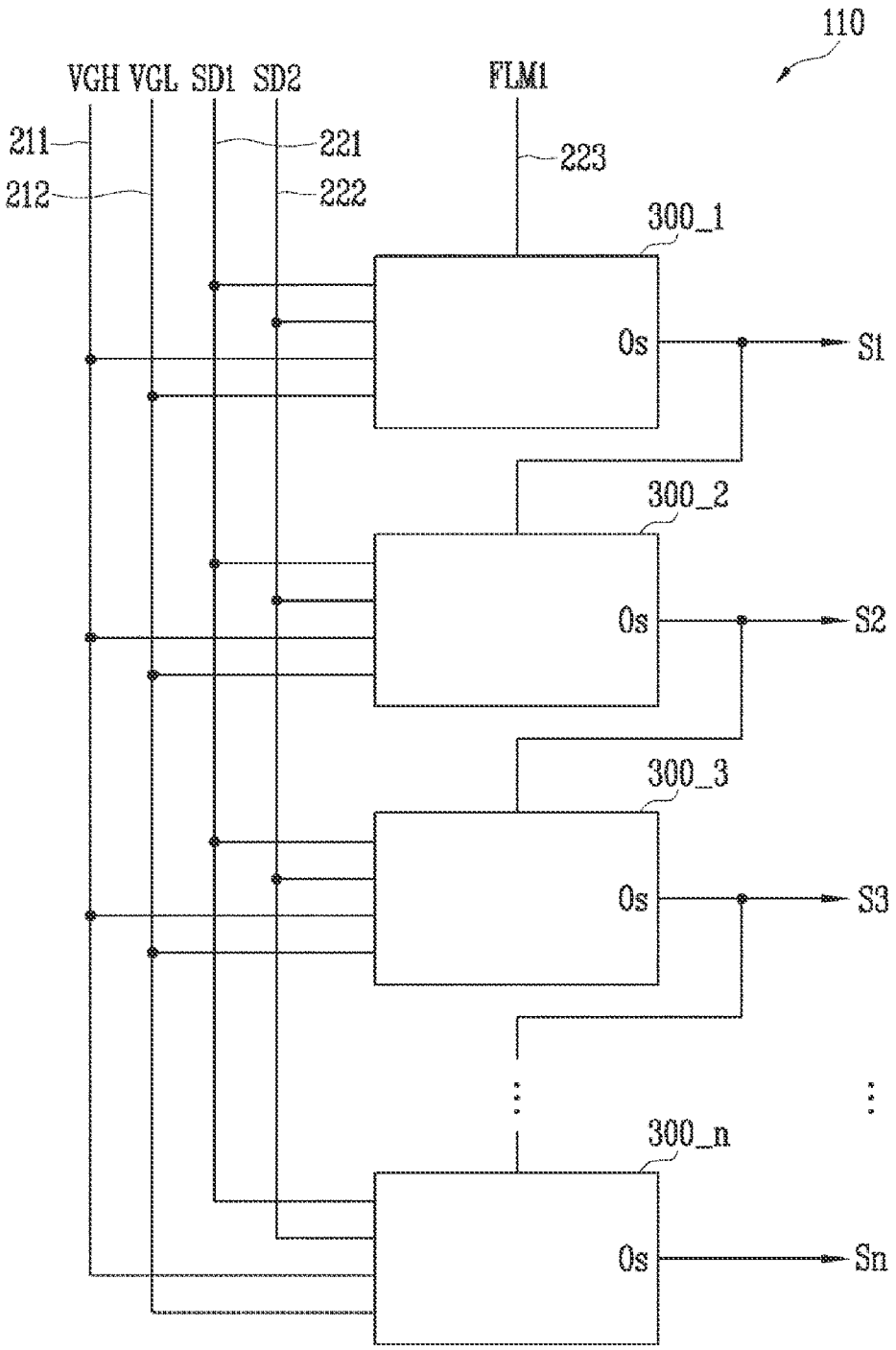
FIG. 5 is a view illustrating the scan driver according to an embodiment.

FIG. 5 is a view illustrating the scan driver according to an embodiment.

Referring to FIG. 5, the scan driver 110 according to an embodiment may include a plurality of stage circuits 300_1 to **300_*n***.

Each of the stage circuits 300_1 to **300_*n* may be connected to each of the scan lines S1** to Sn through an output terminal Os.

Furthermore, the stage circuits 300_1 to **300_*n* may output a scan signal to the scan lines S1 to Sn in response to the first scan driving signal SD1 and the second scan driving signal SD2**.

For example, the stage circuits 300_1 to **300_*n* may output the scan signal, starting from the first stage circuit 300_1 to the nth stage circuit 300_*n*** sequentially.

For this purpose, the stage circuits 300_1 to **300_*n* may be supplied with the first driving voltage VGH, the second driving voltage VGL, the first driving signal SD1, the second driving signal SD2, and the first initial signal FLM1**.

A first driving voltage line 211 may be connected between the power supply 30 and the stage circuits 300_1 to **300_*n*, and transmit the first driving voltage VGH output from the power supply 30 to the stage circuits 300_1 to 300_*n***.

The second driving voltage line 212 may be connected between the power supply 30 and the stage circuits 300_1 to **300_*n*, and transmit the second driving voltage VGL output from the power supply to the stage circuits 300_1 to 300_*n***.

A first scan driving signal line 221 may be connected between the timing controller 150 and the stage circuits 300_1 to **300_*n*, and transmit the first scan driving signal SD1 output from the timing controller 150 to the stage circuits 300_1 to 300_*n***.

A second scan driving signal line 222 may be connected between the timing controller 150 and the stage circuits 300_1 to **300_*n*, and transmit the second scan driving signal SD2 output from the timing controller 150 to the stage circuits 300_1 to 300_*n***.

A first initial signal line 233 may be connected between the timing controller 150 and the first stage circuit 300_1, and transmit the first initial signal FLM1 output from the timing controller 150 to the first stage circuit 300_1.

The stage circuits 300_2 to **300_*n* except for the first stage circuit 300_1 may be connected to the output terminal Os of the previous stage circuits 300_1 to 300_*n*−1**.

Therefore, the remaining stage circuits 300_2 to **300_*n* may each receive the scan signal being output from the previous stage circuits 300_*n* to 300_*n*−1** as an initial signal.

Figure 6:
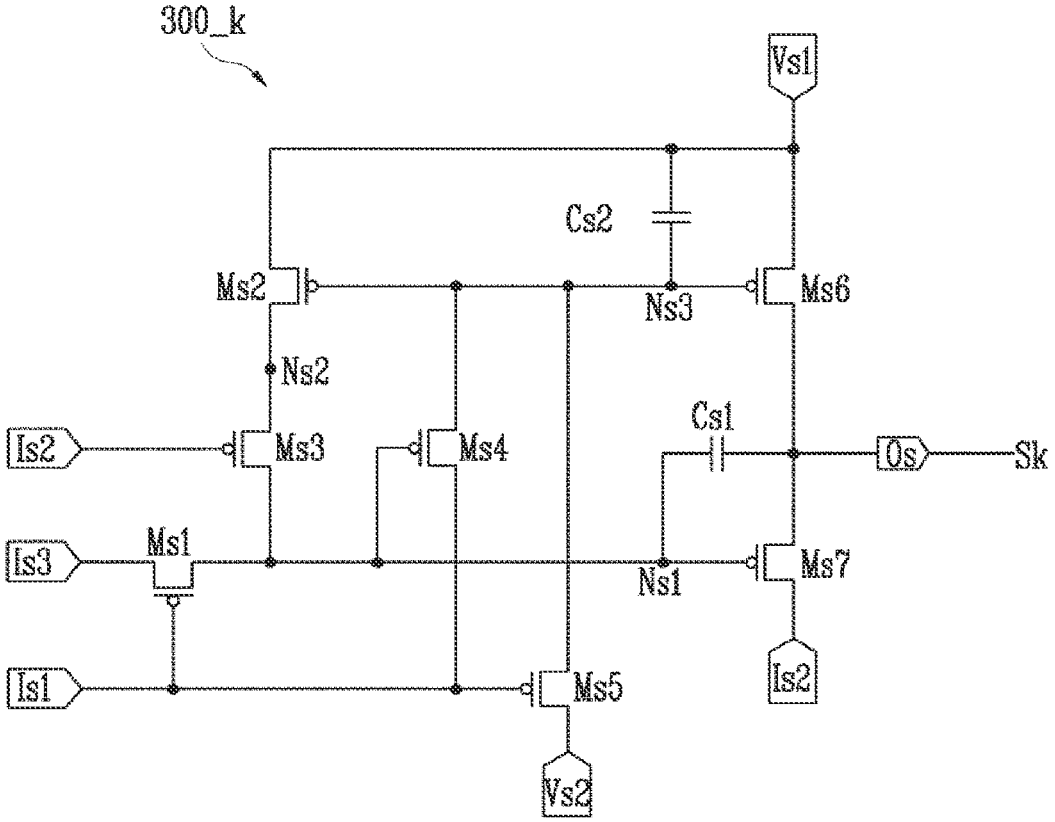
FIG. 6 is a view illustrating an example of a stage circuit included in the scan driver illustrated in FIG. 5.

FIG. 6 is a view illustrating an embodiment of the stage circuit included in the scan driver illustrated in FIG. 5. Especially, the $k^{th}$ (k being a natural number from 1 to n) stage circuit **300_*k* of the scan driver 110** is illustrated as a representative example.

Referring to FIGS. 5 and 6, the $k^{th}$ stage circuit **300_*k* of the scan driver 110 according to an embodiment may include a first transistor Ms1, a second transistor Ms2, a third transistor Ms3, a fourth transistor Ms4, a fifth transistor Ms5, a sixth transistor Ms6, a seventh transistor Ms7, a first capacitor Cs1, and a second capacitor Cs2**.

The first transistor Ms1 may be connected between a third input terminal Is3 and a first node Ns1, and the first transistor Ms1 may include a gate electrode connected to the first input terminal Is1.

Accordingly, the first transistor Ms1 may be turned-on or turned-off according to a voltage level of the first input terminal Is1.

The second transistor Ms2 may be connected between a second node Ns2 and a first voltage terminal Vs1, and the second transistor Ms2 may include a gate electrode connected to third node Ns3.

Accordingly, the second transistor Ms2 may be turned-on or turned-off according to a voltage level of the third node Ns3.

The third transistor Ms3 may be connected between the first node Ns1 and the second node Ns2, and the third transistor Ms3 may include a gate electrode connected to a second input terminal Is2.

Accordingly, the third transistor Ms3 may be turned-on or turned-off according to a voltage level of the second input terminal Is2.

The fourth transistor Ms4 may be connected between the third Ns3 and the first input terminal Is1, and the fourth transistor Ms4 may include a gate electrode connected to the first node Ns1.

Accordingly, the fourth transistor Ms4 may be turned-on or turned-off according to a voltage level of the first node Ns1.

The fifth transistor Ms5 may be connected between the third node Ns3 and a second voltage terminal Vs2, and the fifth transistor Ms5 may include a gate electrode connected to the first input terminal Is1.

Accordingly, the fifth transistor Ms5 may be turned-on or turned-off according to the voltage level of the first input terminal Is1.

The sixth transistor Ms6 may be connected between the first voltage terminal Vs1 and the output terminal Os, and the sixth transistor Ms6 may include a gate electrode connected to the third node Ns3.

Accordingly, the sixth transistor Ms6 may be turned-on or turned-off according to the voltage level of the third node Ns3.

The seventh transistor Ms7 may be connected between the output terminal Os and the second input terminal Is2, and the seventh transistor Ms7 may include a gate electrode connected to the first node Ns1.

Accordingly, the seventh transistor Ms7 may be turned-on or turned-off according to the voltage level of the first node Ns3.

Herein, the output terminal Os may be connected to the $k^{th}$ scan line Sk.

The first capacitor Cs1 may be connected between the first node Ns1 and the output terminal Os.

The second capacitor Cs2 may be connected between the first voltage terminal Vs1 and the third node Ns3.

The stage circuits 300_1 to **300_*n* illustrated in FIG. 5 may each have a same structure as the $k^{th}$ stage circuit 300_*k*** mentioned above.

Hereinafter, the connection relationship of the stage circuits 300_1 to **300_*n* illustrated in FIG. 5** will be explained in more detail.

For example, the first voltage terminal Vs1 of each of the stage circuits 300_1 to **300_*n* may be connected to the first driving voltage line 211, and the second voltage terminal Vs2 of each of the stage circuits 300_1 to 300_*n* may be connected to the second driving voltage line 212**.

Therefore, the first voltage terminal Vs1 and the second voltage terminal Vs2 of each the stage circuits 300_1 to **300_*n*** may receive the first driving voltage VGH and the second driving voltage VGL, respectively.

Furthermore, the first input terminal Is1 of the odd-numbered stage circuits 300_1, 300_3 . . . of the stage circuits 300_1 to **300_*n* may be connected to the first scan driving signal line 221, and the second input terminal Is2 of the odd-numbered stage circuits 300_1, 300_3 . . . of the stage circuits 300_1 to 300_*n* may be connected to the second scan driving signal line 222**.

Therefore, the first input terminal Is1 and the second input terminal Is2 of the odd-numbered stage circuits 300_1, 300_3 . . . of the stage circuits 300_1 to **300_*n* may each receive the first scan driving signal SD1 and the second scan driving signal SD2**, respectively.

Furthermore, the first input terminal Is1 of the even-numbered stage circuits 300_2, 300_4 . . . of the stage circuits 300_1 to **300_*n* may be connected to the second scan driving signal line 222, and the second input terminal Is2 of the even-numbered stage circuits 300_2, 300_4 . . . of the stage circuits 300_1 to 300_*n* may be connected to the first scan driving signal line 221**.

Therefore, the first input terminal Is1 and the second input terminal Is2 of the even-numbered stage circuits 300_2, 300_4 . . . of the stage circuits 300_1 to **300_*n* may each receive the second scan driving signal SD2 and the first scan driving signal SD1**, respectively.

Furthermore, the third input terminal Is3 of the first stage circuit 300_1 of the stage circuits 300_1 to **300_*n* may be connected to a first initial signal line 223**.

Therefore, the first stage circuit 300_1 and the third input terminal Is3 may receive the first initial signal FLM1.

The third input terminal Is3 of the remaining stage circuits 300_2 to **300_*n* except for the first stage circuit 300_1 may be connected to the output terminal Os of the previous stage circuits 300_1 to 300_*n*−1**.

For example, the third input terminal Is3 of the $j^{th}$ (j being a natural of 2 or above) stage circuit **300_*j* of the stage circuits 300_1 to 300_*n* may be connected to the output terminal Os of the $j-1^{th}$ stage circuit 300_*j*−1**.

Therefore, the third input terminal Is3 of the $j^{th}$ stage circuit **300_*j* may receive the scan signal being output from the $j-1^{th}$ stage circuit 300_*j*−1** as an initial signal.

Figure 7:
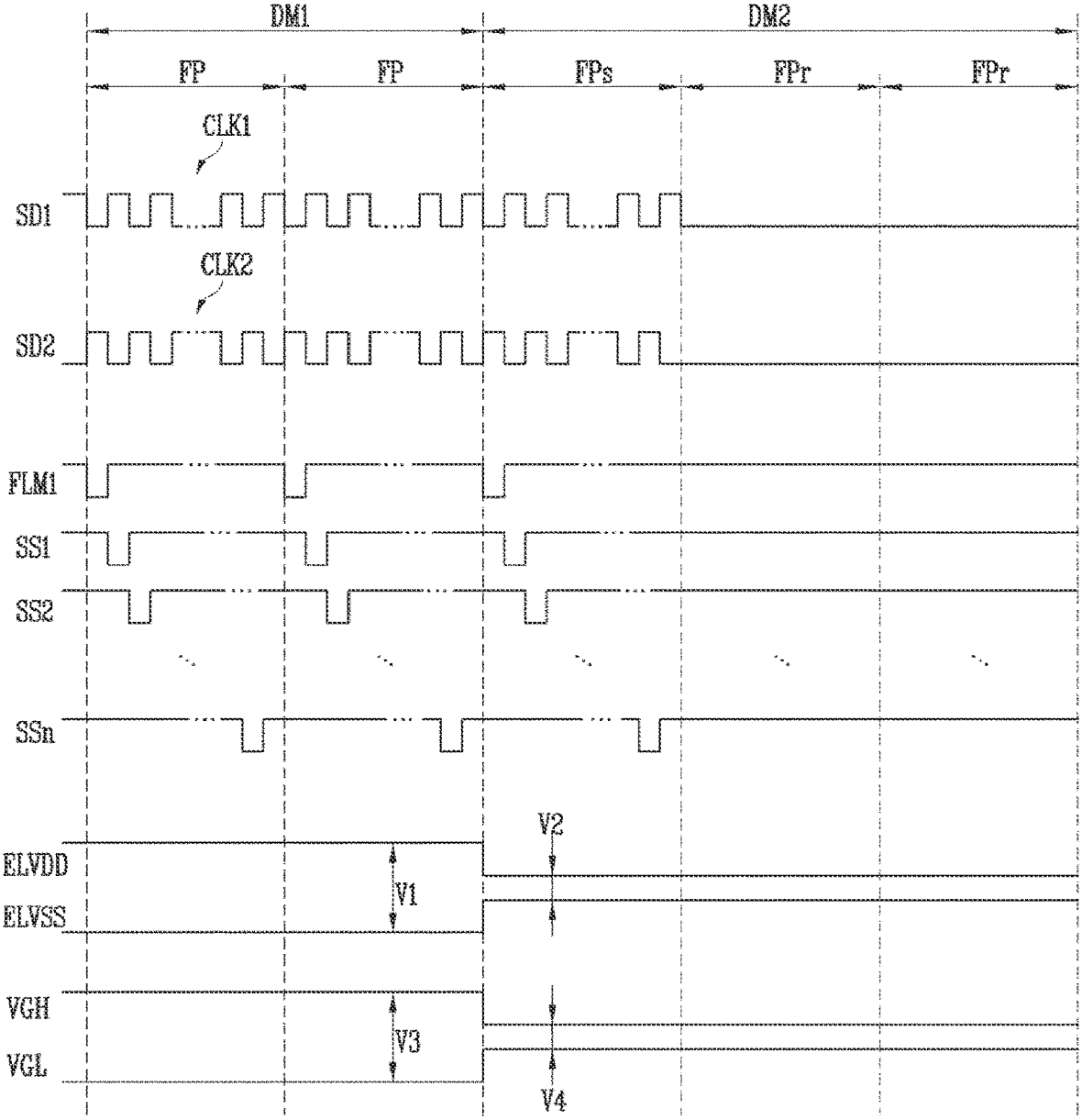
FIG. 7 is a waveform diagram to be used in describing operations of a display device, e.g., an organic light emitting display device, with elements illustrated in FIG. 3.

FIG. 7 is a waveform diagram illustrating operations of the display device 1, e.g., the organic light emitting display device 1, with elements illustrated in FIG. 3.

Hereinafter, operations of the organic light emitting display device 1 during each driving mode DM1 and DM2 will be explained with reference to FIG. 7.

During the first driving mode DM1, the display driver 20 may enable new image frames.

For example, the scan driver 110 may supply (copies of) scan signals SS1, SS2, SSn, etc. to the scan lines S1, S2, Sn, respectively, at every frame period FP that proceeds during the first driving mode DM1.

Each of the scan signals SS1 to SSn may be set to a voltage capable of turning-on the transistor (for example, the first pixel transistor T1 of FIG. 4) to be supplied with that scan signal SS1 to SSn. For example, each scan signal SS1 to SSn may be set to a low level voltage.

Furthermore, the data driver 120 may supply the data signal to the data lines D1 to Dm at every frame period FP that proceeds during and/or corresponds to the first driving mode DM1. Each frame period FP may correspond to a (new) image frame.

At this time, the data signal may be synchronized with the scan signal SS1 to SSn and then provided, and the data signal may be registered in the pixel PXL that is supplied with the scan signal SS1 to SSn.

For such an operation of the scan driver 110, during the first driving mode DM1, the first initial signal FLM1 may be supplied to the scan driver 110 at every frame period FP.

Furthermore, during the first driving mode DM1, the first scan driving signal SD1 and the second driving signal SD2 may be set as a first clock signal CLK1 and a second clock signal CLK2, respectively.

The first initial signal FLM1 may be supplied to the third input terminal Is3 of the first stage circuit 300_1 included in the scan driver 110. For example, the first initial signal FLM1 may be set to a low level voltage.

The first clock signal CLK1 and the second clock signal CLK2 may be set as clock signals of which a low level voltage and a high level voltage are periodically repeated. For example, the first clock signal CLK1 may be set as a clock signal having a phase opposite to the second clock signal CLK2.

As the first initial signal FLM1 is supplied and the first scan driving signal SD1 and the second scan driving signal SD2 are set as clock signals, the stage circuits 300-1 to **300_*n* included in the scan driver 110 may sequentially output scan signal SS1 to SSn to the scan lines S1** to Sn.

A plurality of frame periods that proceeds during and/or corresponds to the second driving mode DM2 may include at least one supply frame period FPs (or supply period FPs) and a hold period that includes a plurality of remaining frame periods FPr (or frame-length periods FPr remaining in the second driving mode DM2). The supply period FPs may be as long as each frame period FP. Each frame-length period FPr may correspond to no new image frame and may be as long as each frame period FP.

During the second driving mode DM2, only an image with a lower frame frequency than the first driving mode DM1 should be displayed, and thus the display driver 20 may be set to enable new image frames only during some frame periods (for example, supply frame period FPs) during the second driving mode DM2.

For example, the scan driver 110 may supply scan signals SS1, SS2, SS3, SSn, etc. to the scan lines S1, S2, S3, Sn, etc., respectively, during the supply frame period FPs, and the data driver 120 may supply data signals to the data lines D1, D2, Dm, etc. during the supply frame period FPs.

For this purpose, during the supply frame period FPs, the first initial signal FLM1 may be supplied, and the first scan driving signal SD1 and the second scan driving signal SD2 may be set as the first clock signal CLK1 and the second clock signal CLK2, respectively.

Accordingly, during the supply frame period FPs, the stage circuits 300_1 to **300_*n* included in the scan driver 110 may sequentially output scan signals SS1 to SSn to the scan lines S1** to Sn.

At this time, the data signal may be registered in the pixel PXL that is supplied with the scan signals SS1 to SSn, and each pixel PXL may emit light in a brightness corresponding to the registered data signal.

The scan driver 110 may stop the supply of the scan signals SS1 to SSn during the remaining frame periods FPr, and the data driver 120 may stop the supply of data signals during the remaining frame periods FPr.

For this purpose, during the remaining frame periods FPr, the supply of the first initial signal FLM1 may be stopped, and the first scan driving signal SD1 and the second scan driving signal SD2 may be maintained at a constant voltage level.

For example, during the remaining frame periods FPr, the voltage level of the first scan driving signal SD1 may be set to be the same as the low level voltage of the first clock signal CLK1, and the voltage level of the second scan driving signal SD2 may be set to be the same as the low level voltage as the second clock signal CLK2.

Accordingly, during the remaining frame periods FPr, the stage circuits 300_1 to **300_*n* included in the scan driver 110 may be stopped from supplying the scan signals SS1** to SSn.

For example, in the case where the first scan driving signal SD1 and the second scan driving signal SD2 are set to a low level voltage, the fifth transistor Ms5 included in each of the stage circuits 300_1 to **300_*n* may be turned-on, and accordingly, the second driving voltage VGL having a low level may be applied to the gate electrode of the sixth transistor Ms6**.

Furthermore, in the case where the second driving voltage VGL is applied to the gate electrode of the sixth transistor Ms6, the sixth transistor Ms6 may be turned-on, and accordingly, the first driving voltage VGH of a high level may be supplied to the output terminal Os.

Therefore, during the remaining frame periods FPr, the stage circuits 300_1 to **300_*n* included in the scan driver 110 may continue to output a high level voltage, such that the scan signals SS1** to SSn do not provide the low level voltage.

As aforementioned, since operations of the scan driver 110 and the data driver 120 are minimized during the second driving mode DM2, power consumption may be reduced.

Even if the scan signals SS1 to SSn and the data signal are stopped from being supplied during the remaining frame periods FPr, since each pixel PXL stores the voltage corresponding to the data signal supplied during the supply frame period FPs, it is possible for the pixels PXL to keep emitting light as in the supply frame period FPs even during the remaining frame periods FPr.

However, in the case of performing a low frequency operation as in the second driving mode DM2, a flickering phenomenon may occur due to the hysteresis of the driving transistor (for example, the second pixel transistor T2) included in the pixel PXL and the current leak existing in the pixel PXL.

Therefore, the power supply 30 according to an embodiment may adjust the level of the pixel voltage ELVDD and ELVSS according to the driving mode DM1 and DM2.

For example, during the first driving mode DM1, the power supply 30 may set the level of the first pixel voltage ELVDD and the second pixel voltage ELVSS such that the driving transistor included in the pixel PXL may operate in a saturation region.

Therefore, during the first driving mode DM1, the driving transistor may operate by current source, and supply the current corresponding to the voltage stored in the storage capacitor Cst to the organic light emitting diode OLED.

At this time, the data signal may be set to various voltage levels corresponding to the gradation intended to be expressed.

Furthermore, during the second driving mode DM2, the power supply 30 may set the level of the first pixel voltage ELVDD and the second pixel voltage ELVSS such that the driving transistor included in the pixel PXL may operate in a linear region.

Therefore, the driving transistor may be operated by a switch during the second driving mode DM2, and whether or not to emit light from the organic light emitting diode OLED may be controlled.

At this time, the data driver 120 may supply the data signal corresponding to whether or not to emit light to the data lines D1 to Dm.

The data driver 120 may control the voltage level of the data signal such that the driving transistor included in the pixel PXL may be operated merely by the switch.

For example, it is possible to supply a voltage low enough to completely turn-on the driving transistor when the pixel PXL emits light, and supply a voltage high enough to completely turn-off the driving transistor when the pixel PXL does not emit light.

Since the driving transistor included in the pixel PXL is operated by the switch during the second driving mode DM2, change in the brightness due to current leakage is significantly reduced. Therefore, even when a low frequency operation is made during the second driving mode DM2, the flickering phenomenon is significantly reduced.

For the aforementioned operations, the power supply 30 may adjust at least one level of the first pixel voltage ELVDD and the second pixel voltage ELVSS such that that a voltage difference V2 between the first pixel voltage ELVDD and the second pixel voltage ELVSS during the second driving mode DM2 is smaller than a voltage difference V1 between the first pixel voltage ELVDD and the second pixel voltage ELVSS during the first driving mode DM1.

For example, the first pixel voltage ELVDD during the second driving mode DM2 may be set to a lower voltage level than during the first driving mode DM1, and the second pixel voltage ELVSS during the second driving mode DM2 may be set to a higher voltage level than during the first driving mode DM1.

Furthermore, the power supply 30 according to an embodiment may adjust the level of the driving voltage VGH and VGL according the driving mode DM1 and DM2 in order to reduce power consumption.

For example, the power supply 30 may adjust at least one level of the first driving voltage VGH and the second driving voltage VGL such that a voltage difference V4 between the first driving voltage VGH and the second driving voltage VGL during the second driving mode DM2 is smaller than a voltage difference V3 between the first driving voltage VGH and the second driving voltage VGL during the first driving mode DM1.

For example, the first driving voltage VGH during the second driving mode DM2 may be set to a lower voltage level than during the first driving mode DM1, and the second driving voltage VGL during the second driving mode DM2 may be set to a higher voltage level than during the first driving mode DM1.

Figure 8:
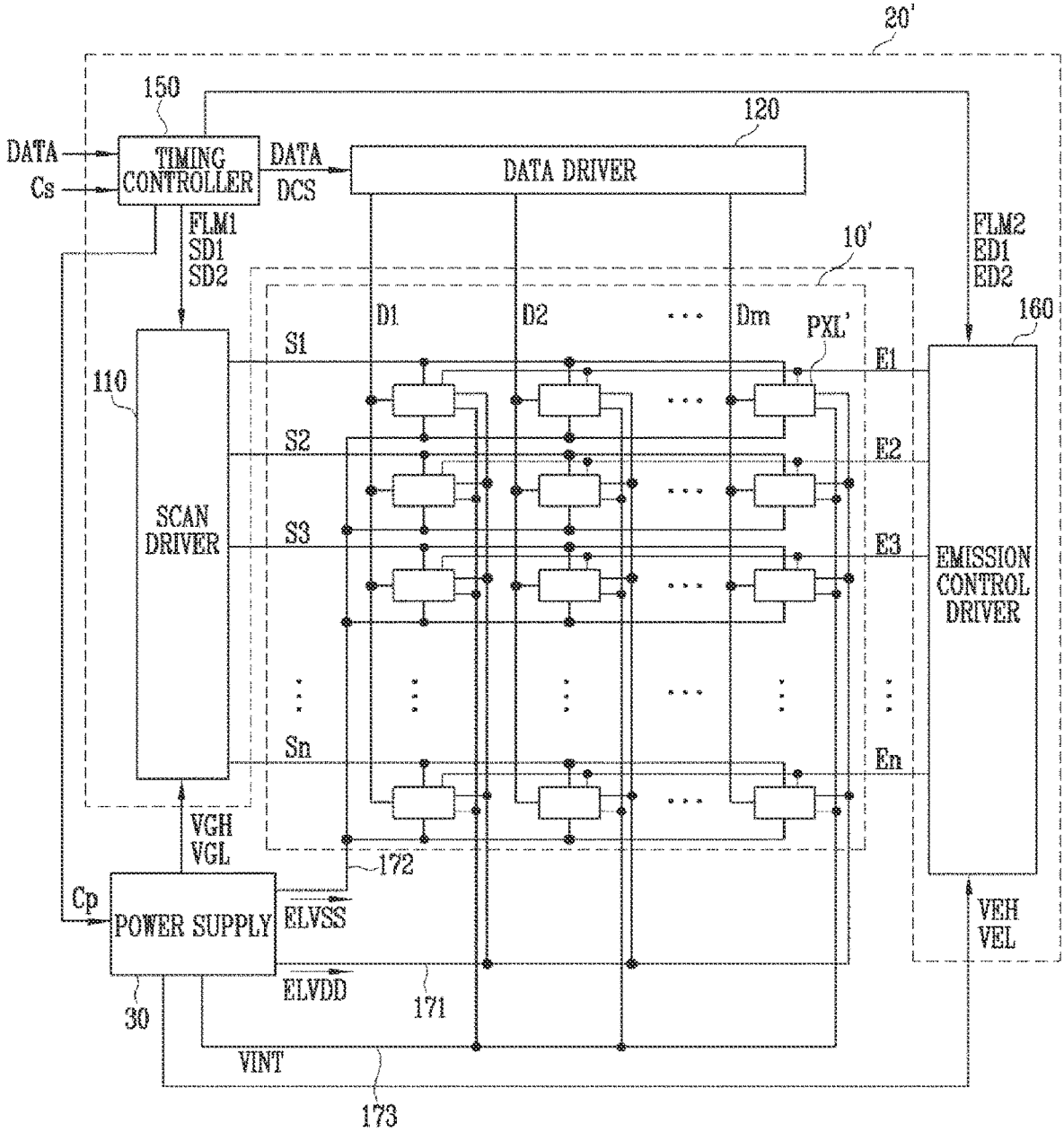
FIG. 8 is a view illustrating a display panel and a display driver according to an embodiment.

FIG. 8 is a view illustrating a display panel and a display driver according to an embodiment.

Hereinafter, explanation will be made with a main focus on the differences from the aforementioned embodiment, and repeated explanation on the same configurations will be omitted.

Referring to FIG. 8, the display panel 10' according to the an embodiment may include a plurality of data lines D1 to Dm, a plurality of scan lines S1 to Sn, a plurality of emission control lines E1 to En, and a plurality of pixels PXL'.

The pixels PXL' may be connected with the data lines D1 to Dm, the scan lines S1 to Sn, and the emission control lines E1 to En.

Furthermore, the pixels PXL' may be supplied with a data signal, a scan signal, and a emission control signal through the data lines D1 to Dm, the scan lines S1 to Sn, and the emission control lines E1 to En.

The data lines D1 to Dm may be connected between the driver 120 and the pixels PXL', the scan lines S1 to Sn may be connected between the scan driver 110 and the pixels PXL', and the emission control lines E1 to En may be connected between the emission control driver 160 and the pixels PXL'.

The pixels PXL' may supply a first pixel voltage ELVDD, a second pixel voltage ELVSS, and an initializing voltage VINT from the power supply 30.

Furthermore, the display driver 20' may include the scan driver 110, the data driver 120, the emission control driver 160, and the timing controller 150.

The scan driver 110 may generate a scan signal according to a control by the timing controller 150, and supply the generated scan signal to the scan lines S1 to Sn.

Therefore, each of the pixels PXL' may be supplied with the scan signal through the scan lines S1 to Sn.

For example, the scan driver 110 may be supplied with a first initial signal FLM1, a first scan driving signal SD1, a second scan driving signal SD2 from the timing controller 150, and operate accordingly.

The data driver 120 may generate a data signal according to a control by the timing controller 150, and supply the generated data signal to the data lines D1 to Dm.

Therefore, the pixels PXL' may be supplied with the data signal through the data lines D1 to Dm.

For example, the data driver 120 may be supplied with image data DATA and a data driver control signal DCS from the timing controller 150, and generate the data signal accordingly.

Furthermore, the data driver 120 may synchronize the generated data signal with the scan signal of the scan driver 110, and supply the synchronized data signal to each pixel PXL'.

The emission control driver 160 may generate an emission control signal according to a control by the timing controller 150, and supply the generated emission control signal to the emission control lines E1 to En.

Therefore, each of the pixels PXL' may be supplied with the emission control signal through the emission control lines E1 to En.

For example, the emission control driver 160 may be supplied with a second initial signal FLM2, a first emission driving signal ED1, and a second emission driving signal ED2 from the timing controller 150, and operate accordingly.

The power supply 30 may supply the first pixel voltage ELVDD, the second pixel voltage ELVSS, and the initializing voltage VINT to the pixels PXL'.

A first pixel power line 171, a second pixel power line 172, and an initialing power line 173 may be connected between the pixels PXL' and the power supply 30.

Therefore, the power supply 30 may supply the first pixel voltage ELVDD and the second pixel voltage ELVSS to each pixel PXL' through the first pixel power line 171 and the second pixel power line 172.

Furthermore, the power supply 30 may supply the initializing voltage VINT to each pixel PXL' through the initializing power line 173.

For example, the first pixel voltage ELVDD may be set to a positive voltage, and the second pixel voltage ELVSS may be set to a negative voltage or a ground voltage.

The power supply 30 may supply a first driving voltage VGH and a second driving voltage VGL to the scan driver 110.

The first driving voltage VGH and the second driving voltage VGL may be set to voltages different from each other.

For example, the first driving voltage VGH may be set to a positive voltage that is higher than the first pixel voltage ELVDD, while the second driving voltage VGL is set to a negative voltage that is lower than the second pixel voltage ELVSS.

Furthermore, the power supply 30 may supply a third driving voltage VEH and a fourth driving voltage VEL to the emission control driver 160.

The third driving voltage VEH and the fourth driving voltage VEL may be set to voltages different from each other.

For example, the third driving voltage VEH may be set to a positive voltage that is higher than the first pixel voltage ELVDD, while the fourth driving voltage VEL is set to a negative voltage that is lower than the second pixel voltage ELVSS.

Furthermore, the third driving voltage VEH and the first driving voltage VGH may be set to a same voltage, and the fourth driving voltage VEL and the second driving voltage VGL may be set to a same voltage.

The timing controller 150 may control the scan driver 110, the data driver 120, the emission control driver 160 and the power supply 30.

For example, the timing controller 150 may control operations of the scan driver 110 by generating the first initial signal FLM1, the first scan driving signal SD1, and the second scan driving signal SD2 using the control signal Cs being supplied from outside, and then supplying the generated first initial signal FLM1, the first scan driving signal SD1, and the second scan driving signal SD2 to the scan driver 110.

The timing controller 150 may convert the image data DATA being supplied from outside into image data that is suitable to the specifications of the data driver 120, and supply the converted image data to the data driver 120.

Furthermore, the timing controller 150 may control operations of the data driver 120 by generating the data driver control signal DCS using the control signal Cs being supplied from outside, and then supplying the generated data driver control signal DCS to the data driver 120.

Furthermore, the timing controller 150 may control operations of the emission control driver 160 by generating the second initial signal FLM2, the first emission driving signal ED1, and the second emission driving signal ED2 using the control signal Cs being supplied from outside, and then supplying the generated the second initial signal FLM2, the first emission driving signal ED1, and the second emission driving signal ED2 to the emission control driver 160.

The timing controller 150 may control operations of the power supply 30 may supplying a power control signal Cp to the power supply 30.

Figure 9:
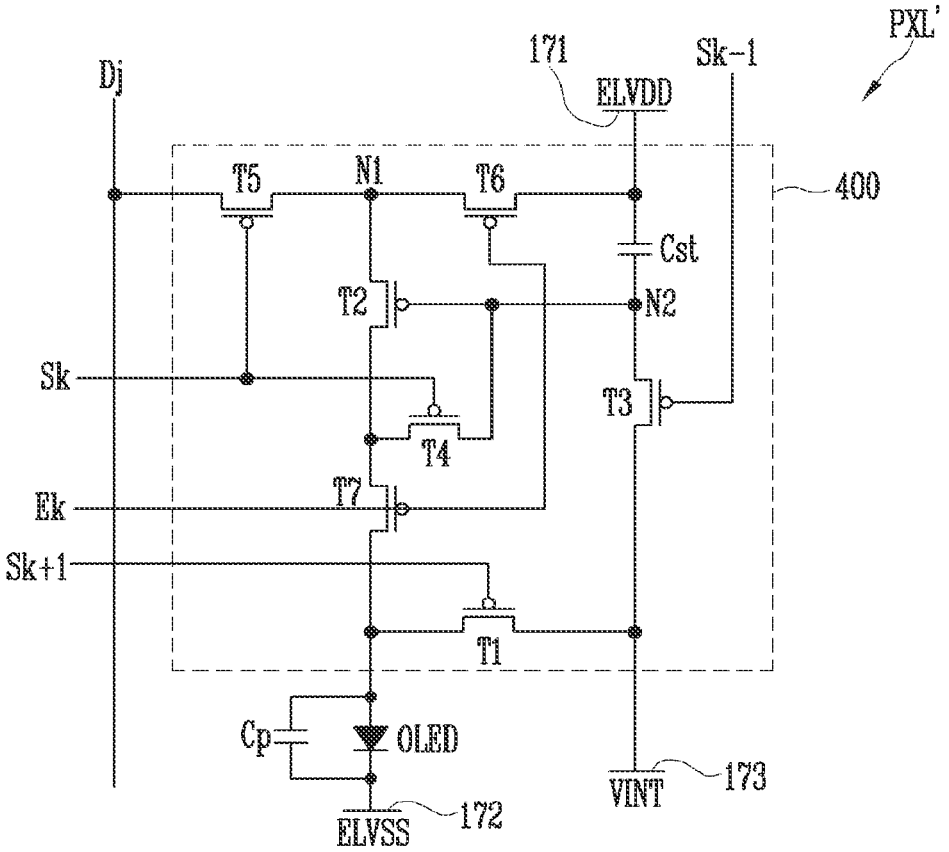
FIG. 9 is a view illustrating an example of a pixel illustrated in FIG. 8.

FIG. 9 is a view illustrating an example of the pixel illustrated in FIG. 3. Especially, for convenience sake, FIG. 9 illustrates a pixel PXL' connected to a $k^{th}$ scan line Sk and a $j^{th}$ data line Dj.

Referring to FIG. 9, the pixel PXL' according to an embodiment may include an organic light emitting diode OLED, and a pixel circuit 400.

An anode electrode of the organic light emitting diode OLED may be connected to the pixel circuit 400, and a cathode electrode of the organic light emitting diode OLED may be connected to the second pixel power line 172.

It is possible for such an organic light emitting diode OLED to generate light of a predetermined brightness in response to a current being supplied from the pixel circuit 400.

The pixel circuit 400 may be located between the $j^{th}$ data line Dj, the $k^{th}$ scan line Sk, and the anode electrode of the organic light emitting diode OLED, and the pixel circuit 400 may control the current being supplied to the organic light emitting diode OLED.

For example, the pixel circuit 400 may control an amount of current being supplied to the organic light emitting diode OLED in response to the data signal being supplied to the $j^{th}$ data line Dj when the scan signal is being supplied to the $k^{th}$ scan line Sk.

The pixel circuit 400 may include a plurality of pixel transistors T1 to T7, and a storage capacitor Cst.

The first pixel transistor T1 is connected between the anode electrode of the organic light emitting diode OLED and the initializing power line 173. Herein, the initializing power line 173 may supply an initializing voltage VINT that is lower than the data signal The first pixel transistor T1 is turned-on when a scan signal is supplied to the $k+1^{th}$ scan line Sk+1, and supplies the initializing voltage VINT to the anode electrode of the organic light emitting diode OLED.

When the initializing voltage VINT is supplied to the anode electrode of the organic light emitting diode OLED, a parasitic capacitor Cp existing in the organic light emitting diode OLED is initialized.

A first electrode of the second pixel transistor (T2: driving transistor) is connected to the first node N1, and the second electrode of the second pixel transistor is connected to the first electrode of a seventh pixel transistor T7.

Furthermore, a gate electrode of the second pixel transistor T2 is connected to a second node N2. Such a second pixel transistor T2 may control an amount of current that flows from the first pixel power line 171 to the second pixel power line 172 via the organic light emitting diode OLED in response to the voltage charged in the storage capacitor Cst.

A first electrode of the third pixel transistor T3 is connected to the second node, and a second electrode of the third pixel transistor T3 is connected to the initializing power line 173.

Furthermore, a gate electrode of the third pixel transistor is connected to a $k-1^{th}$ scan line Sk−1.

Such a third pixel transistor T3 may be turned-on when a scan signal is supplied to the $k-1^{th}$ scan line Sk−1, and the third pixel transistor T3 may supply the initializing voltage VINT to the second node N2.

A first electrode of the fourth pixel transistor T4 is connected to the second electrode of the second pixel transistor T2, and a second electrode of the fourth pixel transistor T4 is connected to the second node N2.

Furthermore, a gate electrode of the fourth pixel transistor T4 is connected to the $k^{th}$ scan line Sk.

Such a fourth pixel transistor T4 may be turned-on when a scan signal is supplied to the $k^{th}$ scan line Sk, and the fourth pixel transistor T4 may connect the second pixel transistor T2 in a diode format.

A first electrode of the fifth pixel transistor T5 is connected to the jth data line Dj, and a second electrode of the fifth pixel transistor T5 is connected to the first node N1.

Furthermore, a gate electrode of the fifth pixel transistor T5 is connected to the $k^{th}$ scan line Sk.

Such a fifth pixel transistor T5 may be turned-on when a scan signal is supplied to the $k^{th}$ scan line Sk, and the fifth pixel transistor T5 may transmit the data signal from the $j^{th}$ data line Dj to the first node N1.

A first electrode of the sixth pixel transistor T6 is connected to the first pixel power line 171, and a second electrode of the sixth pixel transistor T6 is connected to the first node N1.

Furthermore, a gate electrode of the sixth pixel transistor T6 is connected to a $k^{th}$ emission control line Ek.

Such a sixth pixel transistor T6 is turned-on when a emission control signal is supplied to the $k^{th}$ emission control line Ek, and is turned-off when a emission control signal is not supplied.

A first electrode of the seventh pixel transistor T7 is connected to the second electrode of the second pixel transistor T2, and a second electrode of the seventh pixel transistor T7 is connected to the anode electrode of the organic light emitting diode OLED.

Furthermore, a gate electrode of the seventh pixel transistor T7 is connected to the $k^{th}$ emission control line Ek. Such a seventh pixel transistor T7 is turned-on when a emission control signal is supplied to the $k^{th}$ emission control line Ek, and is turned-off when a emission control signal is not supplied.

The storage capacitor Cst is connected between the first pixel power line 171 and the second node N2.

The pixel structure of FIG. 9 explained hereinabove is a mere embodiment. The pixel PXL' is not limited to the aforementioned structure. In fact, the pixel circuit 400 may have a circuit structure where a current may be supplied to the organic light emitting diode OLED, and a pixel structure may be selected from various well known structures in the related field.

Figure 10:
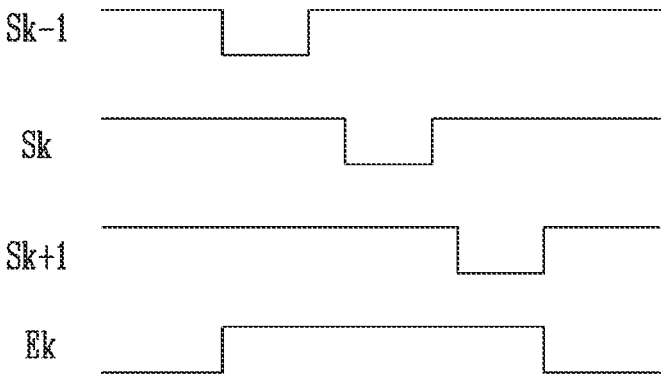
FIG. 10 is a waveform diagram illustrating operations of the pixel illustrated in FIG. 9.

FIG. 10 is a waveform diagram illustrating operations of the pixel illustrated in FIG. 9.

Referring to FIG. 10, first of all, an emission control signal is supplied to the $k^{th}$ emission control line Ek, and thus the sixth pixel transistor T6 and the seventh pixel transistor T7 are turned-off.

When the sixth pixel transistor T6 is turned-off, the first pixel power line 171 and the first node N1 are electrically disconnected from each other.

When the seventh pixel transistor T7 is turned-off, the second pixel transistor T2 and the organic light emitting diode OLED are electrically disconnected from each other.

Therefore, while the light emitting control signal is being supplied to the $k^{th}$ emission control line Ek, the organic light emitting diode OLED is set to a non-light-emitting state.

Thereafter, a scan signal is supplied to the $k-1^{th}$ scan line Sk−1, and the third pixel transistor T3 is turned on.

When the third pixel transistor T3 is turned-on, the initializing voltage VINT is supplied to the second node N2, and accordingly, the voltage of the second node N2 is initialized by the initializing voltage VINT.

After the voltage of the second node N2 is initialized by the initializing voltage VINT, a scan signal is supplied to the $k^{th}$ scan line Sk.

When the scan signal is supplied to the $k^{th}$ scan line Sk, the fourth pixel transistor T4 and the fifth pixel transistor T5 are turned-on.

When the fourth pixel transistor T4 is turned-on, the second pixel transistor T2 is connected in a diode format.

When the fifth pixel transistor T5 is turned-on, a data signal from the $j^{th}$ data line Dj is supplied to the first node N1.

At this time, since the second node N2 is initialized by the initializing voltage VINT, the second pixel transistor T2 is turned-on. When the second pixel transistor T2 is turned-on, a threshold voltage of the second pixel transistor T2 is deducted from the voltage of the data signal applied to the first node N1, and then the remaining voltage is supplied to the second node N2. At this time, the storage capacitor Cst stores the voltage applied to the second node N2.

After the voltage corresponding to the data signal is stored in the storage capacitor Cst, a scan signal is supplied to the $k+1^{th}$ scan line Sk+1. When the scan signal is supplied to the $k+1^{th}$ scan line Sk+1, the first pixel transistor T1 is turned-on.

When the first pixel transistor T1 is turned-on, the initializing voltage VINT is supplied to the anode electrode of the organic light emitting diode OLED.

Then, the parasitic capacitor Cp existing in the organic light emitting diode OLED is initialized.

Thereafter, the supply of the emission control signal to the $k^{th}$ emission control line Ek is stopped, and the sixth pixel transistor T6 and the seventh pixel transistor T7 are turned-on.

When the sixth pixel transistor T6 and the seventh pixel transistor T7 are turned-on, a current path from the first pixel power line 171 to the second pixel power line 172 via the organic light emitting diode OLED is formed.

At this time, the second pixel transistor T2 may supply a driving current corresponding to the voltage charged in the storage capacitor Cst to the organic light emitting diode OLED.

Accordingly, the organic light emitting diode OLED may emit light in a brightness corresponding to the driving current.

Figure 11:
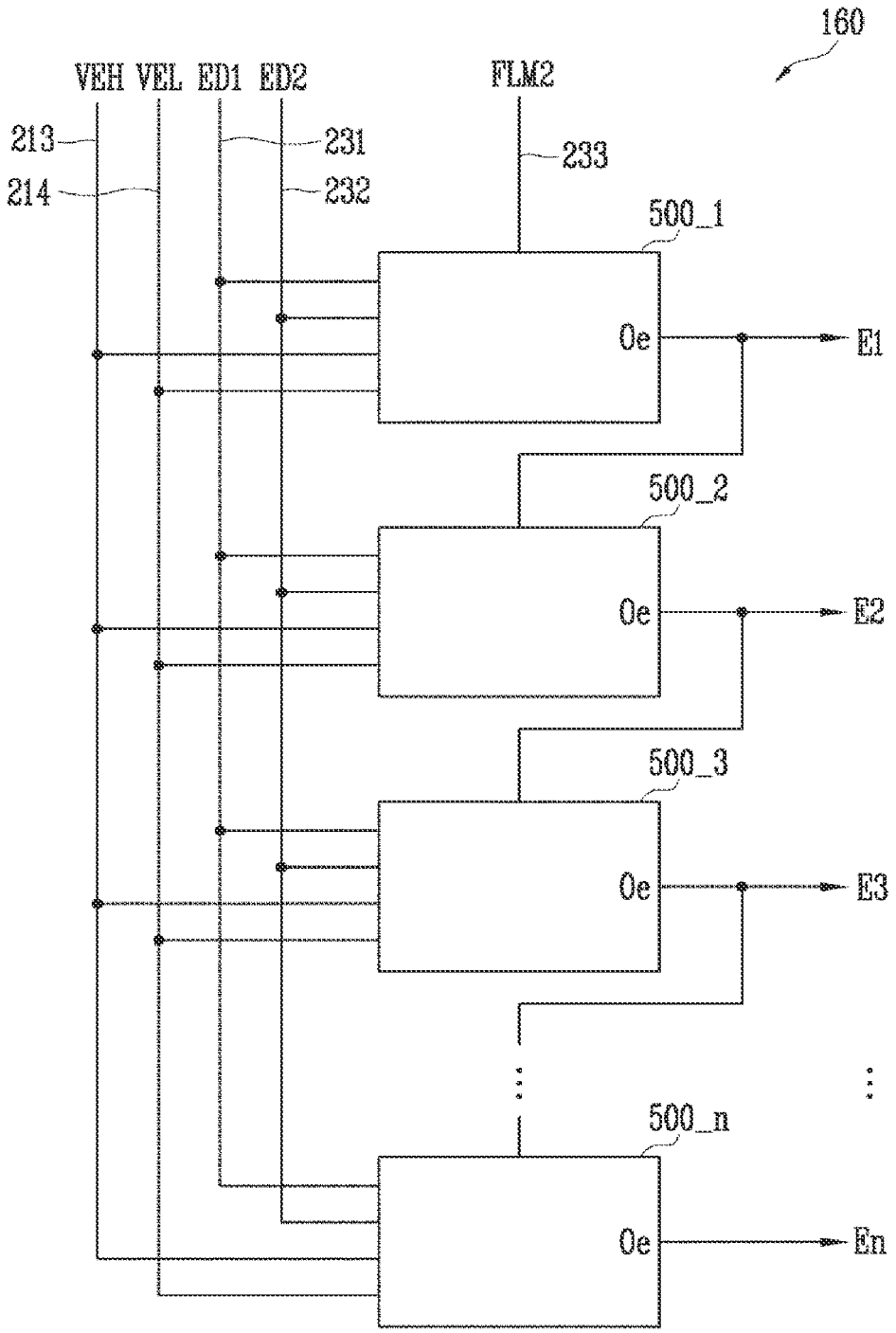
FIG. 11 is a view illustrating an emission control driver according to an embodiment.

FIG. 11 is a view illustrating an emission control driver 160 according to an embodiment.

Referring to FIG. 11, the emission control driver 160 may include a plurality of stage circuits 500_1 to **500_*n***.

The stage circuits 500_1 to **500_*n*** may be connected to emission control lines E1 to En, respectively, through an output terminal Oe.

Furthermore, the stage circuits 500_1 to **500_*n*** may output an emission control signal to the emission control lines E1 to En in response to the first emission driving signal ED1 and the second emission driving signal ED2.

For example, the stage circuits 500_1 to **500_*n* may output emission control signals, starting from the first stage circuit 500_1 to the $n^{th}$ stage circuit 500_*n***, sequentially.

For this purpose, the stage circuits 500_1 to **500_*n*** may be supplied with the third driving voltage VEH, the fourth driving voltage VEL, the first emission control signal ED1, the second emission control signal ED2, and the second initial signal FLM2.

A third driving voltage line 213 may be connected between the power supply 30 and the stage circuits 500_1 to **500_*n*, and transmit the third driving voltage VEH output from the power supply 30 to the stage circuits 500_1 to 500_*n***.

A fourth driving voltage line 214 may be connected between the power supply 30 and the stage circuits 500_1 to **500_*n*, and transmit the fourth driving voltage VEL output from the power supply to the stage circuits 500_1 to 500_*n***.

A first emission driving signal line 231 may be connected between the timing controller 150 and the stage circuits 500_1 to **500_*n*, and transmit the first emission driving signal ED1 output from the timing controller 150 to the stage circuits 500_1 to 500_*n***.

A second emission driving signal line 232 may be connected between the timing controller 150 and the stage circuits 500_1 to **500_*n*, and transmit the second emission driving signal ED2 output from the timing controller 150 to the stage circuits 500_1 to 500_*n***.

A second initial signal line 233 may be connected between the timing controller 150 and the first stage circuit 500_1, and transmit the second initial signal FLM2 output from the timing controller 150 to the first stage circuit 500_1.

The stage circuits 500_2 to 500_*n* except for the first stage circuit 500_1 may be connected to the output terminal Oe of the previous stage circuits 500_1 to 500_*n*−1.

Therefore, the remaining stage circuits 500_2 to 500_*n* may each receive the scan signal being output from the previous stage circuits 500_*n* to 500_*n*−1 as an initial signal.

Figure 12:
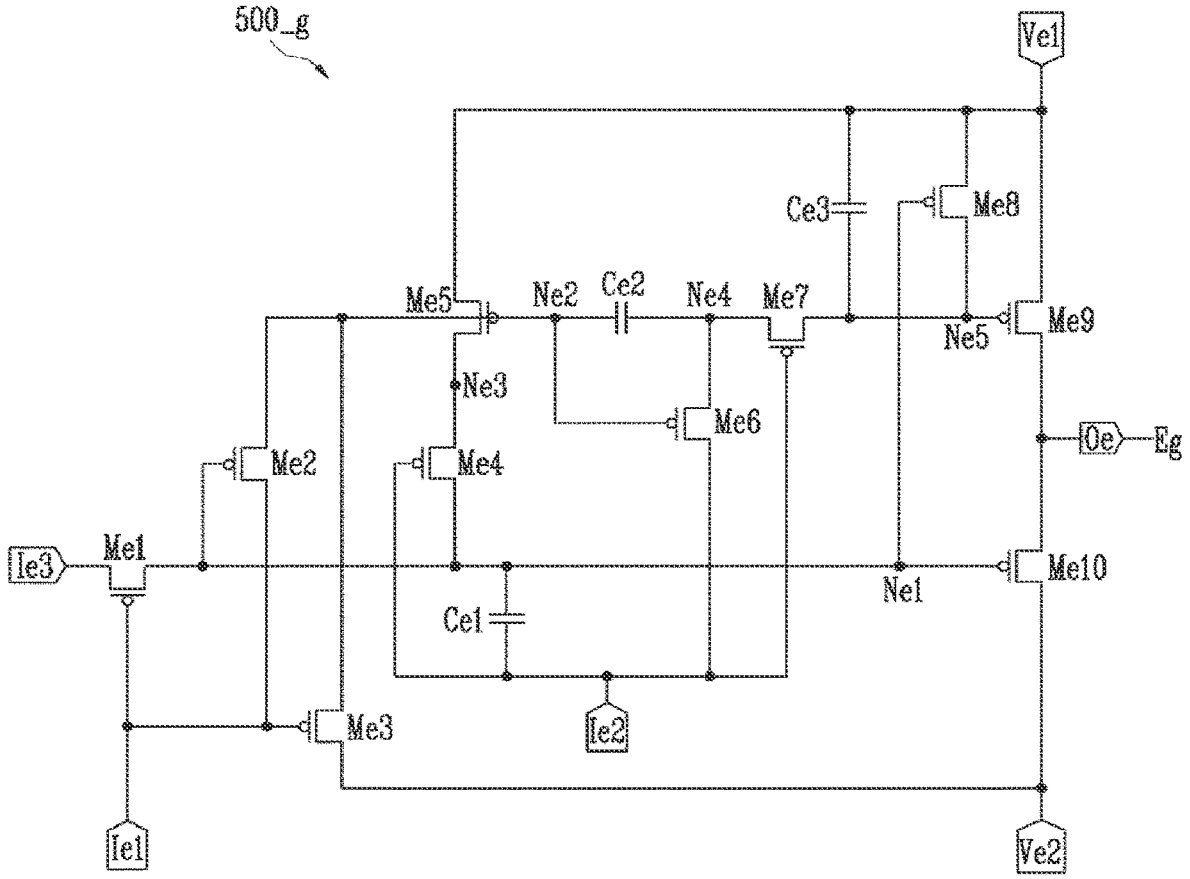
FIG. 12 is a view illustrating an example of a stage circuit included in the light emitting control driver illustrated in FIG. 11.

FIG. 12 is a view illustrating an example of the stage circuit included in the emission control driver illustrated in FIG. 11. Especially, the $g^{th}$ (g being a natural number from 1 to n) stage circuit 500_*g* of the emission control driver 160 is illustrated as a representative example.

Referring to FIGS. 11 and 12, the $g^{th}$ stage circuit 500_*g* of the emission control driver 160 may include a first transistor Me1, a second transistor Me2, a third transistor Me3, a fourth transistor Me4, a fifth transistor Me5, a sixth transistor Me6, a seventh transistor Me1, a first capacitor Ce1, a second capacitor Ce2, and a third capacitor Ce3.

The first transistor Me1 may be connected between a third input terminal Ie3 and a first node Ne1, and the first transistor Me1 may include a gate electrode connected to the first input terminal Ie1.

Accordingly, the first transistor Me1 may be turned-on or turned-off according to a voltage level of the first input terminal Ie1.

The second transistor Me2 may be connected between a second node Ne2 and a first voltage terminal Ve1, and the second transistor Me2 may include a gate electrode connected to the first node Ne1.

Accordingly, the second transistor Me2 may be turned-on or turned-off according to a voltage level of the first node Ne1.

The third transistor Me3 may be connected between the second node Ne2 and a second voltage terminal Ve2, and the third transistor Me3 may include a gate electrode connected to a first input terminal Ie1.

Accordingly, the third transistor Me3 may be turned-on or turned-off according to a voltage level of the first input terminal Ie1.

The fourth transistor Me4 may be connected between the first node Ne1 and the third node Ne3, and the fourth transistor Me4 may include a gate electrode connected to the second input terminal Ie2.

Accordingly, the fourth transistor Me4 may be turned-on or turned-off according to a voltage level of the second input terminal Ie2.

The fifth transistor Me5 may be connected between the first voltage terminal Ve1 and the third node Ne3, and the fifth transistor Me5 may include a gate electrode connected to the second node Ne2.

Accordingly, the fifth transistor Me5 may be turned-on or turned-off according to the voltage level of the second node Ne2.

The sixth transistor Me6 may be connected between a fourth node Ne4 and the second input terminal Ie2, and the sixth transistor Me6 may include a gate electrode connected to the second node Ne2.

Accordingly, the sixth transistor Me6 may be turned-on or turned-off according to the voltage level of the second node Ne2.

The seventh transistor Me7 may be connected between a fourth node Ne4 and a fifth node Ne5, and the seventh transistor Me7 may include a gate electrode connected to the second input terminal Ie2.

Accordingly, the seventh transistor Me7 may be turned-on or turned-off according to the voltage level of the second input terminal Ie2.

The eighth transistor Me8 may be connected between the first voltage terminal Ve1 and the fifth Ne5, and the eighth transistor Me8 may include the gate electrode connected to the first node Ne1.

Accordingly, the eighth transistor Me8 may be turned-on or turned-off according to the voltage level of the first node Ne1.

The ninth transistor Me9 may be connected between the first voltage terminal Ve1 and the output terminal Oe, and the ninth transistor Me9 may include a gate electrode connected to the fifth node Ne5.

Accordingly, the ninth transistor Me9 may be turned-on or turned-off according to the voltage level of the fifth node Ne5.

The tenth transistor Me10 may be connected between the output terminal Oe and the second voltage terminal Ve2, and the tenth transistor ME10 may include a gate electrode connected to the first node Ne1.

Accordingly, the tenth transistor Me10 may be turned-on or turned-off according to the voltage level of the first node Ne1.

Herein, the output terminal Oe may be connected to the $g^{th}$ emission control line Eg.

The first capacitor Ce1 may be connected between the first node Ne1 and the second input terminal Ie2.

The third capacitor Ce2 may be connected between the second node Ne2 and the fourth node Ne4.

The third capacitor Ce3 may be connected between the first voltage terminal Ve1 and the fifth node Ne5.

The stage circuits 500_1 to 500_*n* illustrated in FIG. 11 may each have a same structure as the $g^{th}$ stage circuit 500_*g* mentioned above. Hereinafter, the connection relationship of the stage circuits 500_1 to 500_*n* illustrated in FIG. 11 will be explained in more detail.

For example, the first voltage terminal Ve1 of each of the stage circuits 500_1 to 500_*n* may be connected to the third driving voltage line 213, and the second voltage terminal Ve2 of each of the stage circuits 500_1 to 500_*n* may be connected to the fourth driving voltage line 214.

Therefore, the first voltage terminal Ve1 and the second voltage terminal Ve2 of each the stage circuits 500_1 to 500_*n* may receive the third driving voltage VEH and the fourth driving voltage VEL, respectively.

Furthermore, the first input terminal Ie1 of the odd-numbered stage circuits 500_1, 500_3 . . . of the stage circuits 500_1 to 500_*n* may be connected to the first emission driving signal line 231, and the second input terminal Ie2 of the odd-numbered stage circuits 500_1, 500_3 . . . of the stage circuits 500_1 to 500_*n* may be connected to the second emission driving signal line 232.

Therefore, the first input terminal Ie1 and the second input terminal Ie2 of the odd-numbered stage circuits 500_1, 500_3 . . . of the stage circuits 500_1 to 500_*n* may receive the first emission driving signal ED1 and the second emission driving signal ED2, respectively.

Furthermore, the first input terminal Ie1 of the even-numbered stage circuits 500_2, 500_4 . . . of the stage circuits 500_1 to 500_*n* may be connected to the second emission driving signal line 232, and the second input terminal Ie2 of the even-numbered stage circuits 500_2, 500_4 . . . of the stage circuits 500_1 to 500_*n* may be connected to the second emission driving signal line 232.

Therefore, the first input terminal Ie1 and the second input terminal Ie2 of the even-numbered stage circuits 500_2, 500_4 . . . of the stage circuits 500_1 to 500_n may receive the second emission driving signal ED2 and the first emission driving signal ED1, respectively.

Furthermore, the third input terminal Ie3 of the first stage circuit 500_1 of the stage circuits 500_1 to 500_n may be connected to the second initial signal line 233.

Therefore, the third input terminal Ie3 of the first stage circuit 500_1 may receive the second initial signal FLM2.

The third input terminal Ie3 of the remaining stage circuits 500_2 to 500_n except for the first stage circuit 500_1 may be connected to the output terminal Oe of the previous stage circuits 500_1 to 500_n−1.

For example, the third input terminal Ie3 of the $j^{th}$ (j being a natural of 2 or above) stage circuit 500_j of the stage circuits 500_1 to 500_n may be connected to the output terminal Oe of the $j-1^{th}$ stage circuit 500_j−1.

Therefore, the third input terminal Ie3 of the $j^{th}$ stage circuit 500_j may receive the emission control signal being output from the $j-1^{th}$ stage circuit 500_j−1 as an initial signal.

Figure 13:
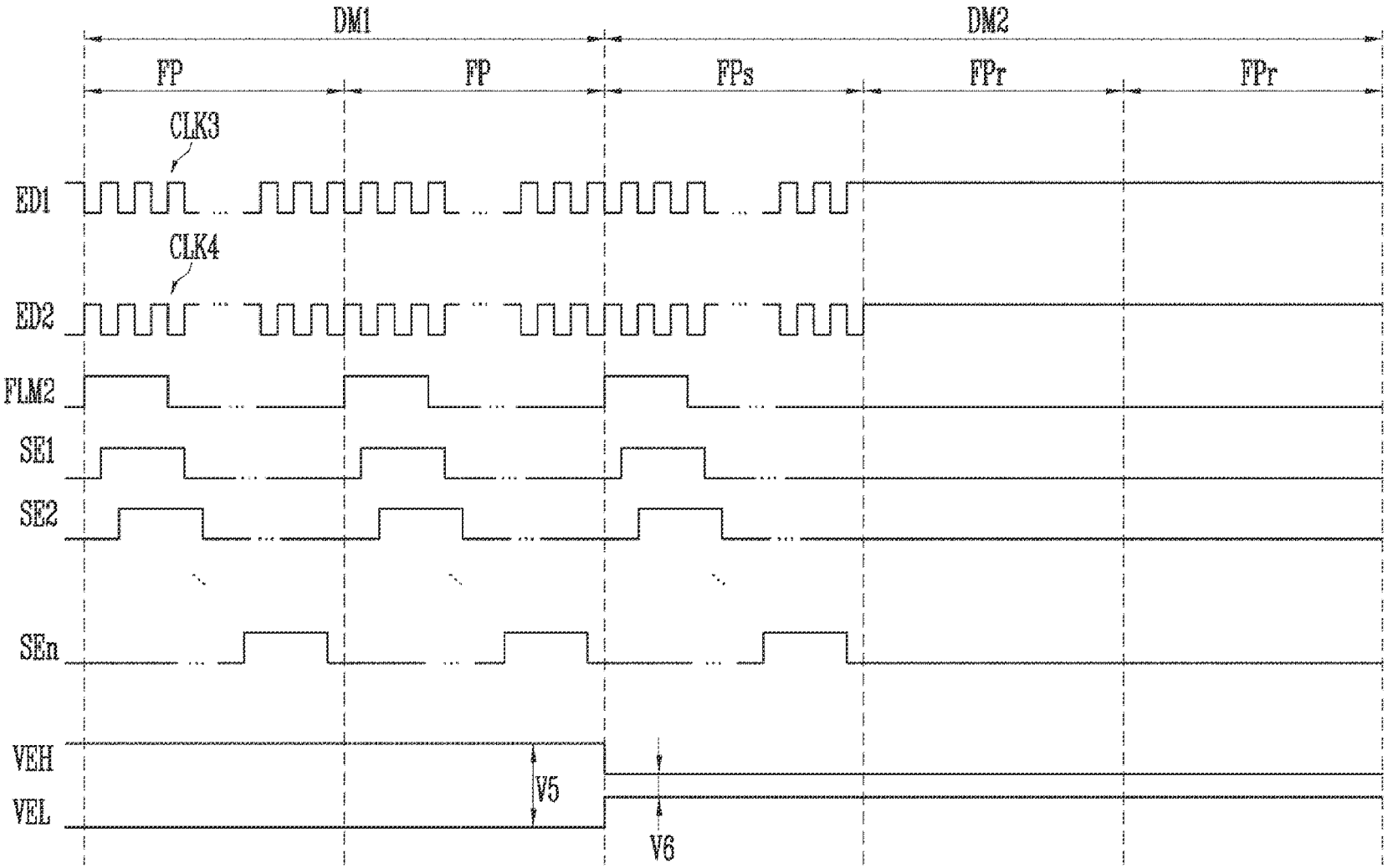
FIG. 13 is a waveform diagram to be used in describing operations of a display device, e.g., an organic light emitting display device, with elements illustrated in FIG. 8.

FIG. 13 is a waveform diagram illustrating operations of a display device, e.g., an organic light emitting display device, with elements illustrated in FIG. 8.

Operations of the scan driver 110 and the data driver 120 may be analogous to and/or substantially identical to operations described above. Operations of the emission control driver 160 are further described.

During the first driving mode DM1, the display driver 20' may enable new image frames.

For example, the emission control driver 160 may supply (copies of) emission control signals SE1, SE2, SE3, SEn, etc. to the emission control lines E1, E2, E3, En, etc., respectively, at every frame period FP that proceeds in and/or correspond to the first driving mode DM1. Each frame period may correspond to a (new) image frame.

Each of the emission control signals SE1 to SEn may be set to a voltage capable of turning-on the transistor (for example, the sixth pixel transistor T6 and the seventh pixel transistor T7 of FIG. 9) to be supplied with the emission control signal SE1 to SEn. For example, each of the emission control signals SE1 to SEn may be set to a high level voltage.

For such an operation of the emission control driver 160, during the first driving mode DM1, the second initial signal FLM2 may be supplied to the emission control driver 160 at every frame period FP.

Furthermore, during the first driving mode DM1, the first emission driving signal ED1 and the second emission driving signal ED2 may be set as a third clock signal CLK3 and a fourth clock signal CLK4, respectively.

The second initial signal FLM2 may be supplied to the third input terminal Ie3 of the first stage circuit 500_1 included in the emission control driver 160. For example, the second initial signal FLM2 may be set to a high level voltage.

The third clock signal CLK3 and the fourth clock signal CLK4 may be set as clock signals of which a low level voltage and a high level voltage are periodically repeated. For example, the third clock signal CLK3 may be set as a clock signal having a phase opposite to the fourth clock signal CLK4.

As the second initial signal FLM2 is supplied and the first emission driving signal ED1 and the second emission driving signal ED2 are set as clock signals, the stage circuits 500-1 to 500_n included in the emission control driver 160 may sequentially output emission control signals SE1 to SEn to the emission control lines E1 to En.

A plurality of frame periods (or frame-length periods) that proceed during and/or correspond to the second driving mode DM2 may include at least one supply frame period FPs (or supply period FPs) and a hold period that includes a plurality of remaining frame periods FPr (or frame-length periods FPr remaining in the second driving mode DM2). The supply period FPs may be as long as each frame period FP. Each frame-length period FPr may be as long as each frame period FP and may correspond to no new image frame.

To reduce power consumption, the display driver 20' may be set to enable new image frames only during some frame periods (for example, supply frame period FPs) during the second driving mode DM2.

For example, the emission control driver 160 may supply an emission control signal SE1 to SEn to each of the emission control lines E1 to En, respectively, during the supply frame period FPs.

For this purpose, during the supply frame period FPs, the second initial signal FLM2 may be supplied, and the first emission driving signal ED1 and the second emission driving signal ED2 may be set as the third clock signal CLK3 and the fourth clock signal CLK4, respectively.

Accordingly, during the supply frame period FPs, the stage circuits 500_1 to 500_n included in the emission control driver 160 may sequentially output emission control signals SE1 to SEn to the emission control lines E1 to En.

The emission control driver 160 may stop the supply of the emission control signals SE1 to SEn during the remaining frame periods FPr.

For this purpose, during the remaining frame periods FPr, the supply of the second initial signal FLM2 may be stopped, and the first emission driving signal ED1 and the second emission driving signal ED2 may be maintained at a constant voltage level.

For example, during the remaining frame periods FPr, the voltage level of the first emission driving signal ED1 may be set to be the same as the high level voltage of the third clock signal CLK3, and the voltage level of the second emission driving signal ED2 may be set to be the same as the high level voltage as the fourth clock signal CLK4.

Accordingly, during the remaining frame periods FPr, the stage circuits 500_1 to 500_n included in the emission control driver 160 may be stopped from supplying the emission control signals SE1 to SEn.

For example, in the case where the first emission driving signal ED1 and the second emission driving signal ED2 are set to a high level voltage, to the output terminal Os of each of the stage circuits 500_1 to 500_n, a low level voltage may be output.

Therefore, during the remaining frame periods FPr, the stage circuits 500_1 to 500_n included in the emission control driver 160 may continue to output a low level voltage instead of the emission control signals SE1 to SEn having a high level voltage.

As aforementioned, since operation of the emission control driver 160 is minimized during the second driving mode DM2, power consumption may be reduced.

Since each pixel PXL' stores the voltage corresponding to the data signal supplied during the supply frame period FPs and the sixth pixel transistor T6 and the seventh pixel transistor T7 included in each pixel PXL' are turned-on during the remaining frame periods FPr, it is possible for the pixels PXL to keep emitting light as in the supply frame period FPs even during the remaining frame periods FPr.

Furthermore, the power supply 30 according to an embodiment may adjust the level of the driving voltages VEH and VEL according to the driving mode DM1 and DM2 in order to reduce power consumption.

For example, the third driving voltage VEH during the second driving mode DM2 may be set to a lower voltage level than during the first driving mode DM1, and the fourth driving voltage VEL during the second driving mode DM2 may be set to a higher voltage level than during the first driving mode DM1.

Example embodiments are disclosed herein. Those of ordinary skill in the art as of the filing of the present application would understand that features, characteristics, and/or elements described in connection with a particular embodiment may be used singly or in combination with features, characteristics, and/or elements described in connection with other embodiments unless otherwise specifically indicated. Those of ordinary skill in the art would also understand that various changes in form and details may be made without departing from the spirit and scope of the embodiments.

What is claimed is:

1. An organic light emitting display device comprising:

a display panel comprising a plurality of scan lines, a plurality of data lines, and a plurality of pixels connected to the plurality of scan lines and to the plurality of data lines;

a power supply for supplying a first pixel voltage and a second pixel voltage to the plurality of pixels; and a display driver configured to control the display panel, wherein the display panel displays a first image in a first frame frequency during a first driving mode, and displays a second image in a second frame frequency that is lower than the first frame frequency during a second driving mode, according to a control by the display driver, wherein the power supply adjusts at least one level of the first pixel voltage and the second pixel voltage such that a voltage difference between the first pixel voltage and the second pixel voltage during the second driving mode is smaller than a voltage difference between the first pixel voltage and the second pixel voltage during the first driving mode, and wherein the first pixel voltage during the second driving mode is set to a lower voltage level than during the first driving mode, and the second pixel voltage during the second driving mode is set to a higher voltage level than during the first driving mode.

2. The organic light emitting display device as claimed in claim 1, wherein the display driver comprises:

a scan driver configured to supply scan signals to the plurality of pixels through the plurality of scan lines;

a data driver configured to supply data signals to the plurality of pixels through the plurality of data lines; and a timing controller configured to control the scan driver and the data driver.

3. The organic light emitting display device as claimed in claim 2, wherein a plurality of frame periods that proceed during the second driving mode comprise at least one supply frame period and a plurality of remaining frame periods, and the scan driver supplies the scan signals to the plurality of scan lines during the at least one supply frame period, and stops supplying the scan signals during the plurality of remaining frame periods.

4. The organic light emitting display device as claimed in claim 3, wherein the data driver supplies the data signals to the plurality of data lines during the at least one supply frame period, and stops supplying the data signals during the plurality of remaining frame periods.

5. The organic light emitting display device as claimed in claim 4, wherein the scan driver supplies the scan signals to the plurality of scan lines at every frame period that proceeds during the first driving mode, and the data driver supplies the data signals to the plurality of data lines at every frame period that proceeds during the first driving mode.

6. The organic light emitting display device as claimed in claim 5, further comprising a first pixel power line and a second pixel power line for transmitting the first pixel voltage and the second pixel voltage to the plurality of pixels, and the plurality of pixels comprise an organic light emitting diode and a driving transistor connected between the first pixel power line and the second pixel power line, respectively.

7. The organic light emitting display device as claimed in claim 6, wherein the driving transistor operates in a saturation region during the first driving mode, and operates in a linear region during the second driving mode.

8. The organic light emitting display device as claimed in claim 5, wherein the timing controller supplies a first scan driving signal and a second scan driving signal to the scan driver, and the scan driver outputs the scan signals in response to the first scan driving signal and the second scan driving signal.

9. The organic light emitting display device as claimed in claim 8, wherein the first scan driving signal is set to a first clock signal during the at least one supply frame period, and is maintained at a constant voltage level during the plurality of remaining frame periods, and the second scan driving signal is set to a second clock signal during the at least one supply frame period, and is maintained at a constant voltage level during the plurality of remaining frame periods.

10. The organic light emitting display device as claimed in claim 9, wherein the voltage level of the first scan driving signal being supplied during the plurality of remaining frame periods is the same as a low level voltage of the first clock signal, and the voltage level of the second scan driving signal being supplied during the plurality of remaining frame periods is the same as a low level voltage of the second clock signal.

11. The organic light emitting display device as claimed in claim 9, wherein the scan driver comprises a plurality of stage circuits connected to the plurality of scan lines, and each of the plurality of stage circuits comprises:

a first transistor connected between a third input terminal and a first node, and comprising a gate electrode connected to a first input terminal;

a second transistor connected between a second node and a first voltage terminal for receiving a first driving voltage, and comprising a gate electrode connected to a third node;

a third transistor connected between the first node and the second node, and comprising a gate electrode connected to a second input terminal;

a fourth transistor connected between the third node and the first input terminal, and comprising a gate electrode connected to the first node;

a fifth transistor connected between the third node and a second voltage terminal for receiving a second driving voltage, and comprising a gate electrode connected to the first input terminal;

a sixth transistor connected between the first voltage terminal and an output terminal, and comprising a gate electrode connected to the third node; and a seventh transistor connected between the output terminal and the second input terminal, and comprising a gate electrode connected to the first node.

12. The organic light emitting display device as claimed in claim 11, wherein each of the plurality of stage circuits further comprises:

a first capacitor connected between the first node and the output terminal; and a second capacitor connected between the first voltage terminal and the third node.

13. The organic light emitting display device as claimed in claim 12, wherein a third input terminal of a first stage circuit of the plurality of stage circuits receives an initial signal from the timing controller, and a third input terminal of a jth stage circuit of the plurality of stage circuits is connected to an output terminal of a j−1th stage circuit, wherein j is a natural number of 2 or above.

14. The organic light emitting display device as claimed in claim 13, wherein a first input terminal and a second input terminal of each of odd-numbered stage circuits of the plurality of stage circuits receive the first scan driving signal and the second scan driving signal, respectively, and a first input terminal and a second input terminal of each of even-numbered stage circuits of the plurality of stage circuits receive the second scan driving signal and the first scan driving signal, respectively.

15. The organic light emitting display device as claimed in claim 5, wherein the power supply supplies a first driving voltage and a second driving voltage to the scan driver, wherein the power supply adjusts at least one level of the first driving voltage and the second driving voltage such that a voltage difference between the first driving voltage and the second driving voltage during the second driving mode is smaller than a voltage difference between the first driving voltage and the second driving voltage during the first driving mode, and wherein the first driving voltage during the second driving mode is set to a lower voltage level than during the first driving mode, and the second driving voltage during the second driving mode is set to a higher voltage level than during the first driving mode.

16. The organic light emitting display device as claimed in claim 3, wherein the display panel further comprises a plurality of emission control lines connected to the plurality of pixels, and the display driver further comprises an emission control driver configured to supply emission control signals to the plurality of pixels through the plurality of emission control lines, to supply the emission control signals to the plurality of emission control lines during the at least one supply frame period, and to stop the supply of the emission control signals during the plurality of remaining frame periods.

17. The organic light emitting display device as claimed in claim 16, wherein the emission control driver supplies the emission control signals to the plurality of emission control lines at every frame period that proceeds during the first driving mode.

18. The organic light emitting display device as claimed in claim 16, wherein the timing controller supplies a first emission driving signal and a second emission driving signal to the emission control driver, and the emission control driver outputs the emission control signals in response to the first emission driving signal and the second emission driving signal.

19. The organic light emitting display device as claimed in claim 18, wherein the first emission driving signal is set to a third clock signal during the at least one supply frame period, and is maintained at a constant voltage level during the plurality of remaining frame periods, and the second emission driving signal is set to a fourth clock signal during the at least one supply frame period, and is maintained at a constant voltage level during the plurality of remaining frame periods.

20. The organic light emitting display device as claimed in claim 19, wherein the voltage level of the first emission driving signal being supplied during the plurality of remaining frame periods is the same as a high level voltage of the third clock signal, and the voltage level of the second emission driving signal being supplied during the plurality of remaining frame periods is the same as a high level voltage of the fourth clock signal.

21. The organic light emitting display device as claimed in claim 19, wherein the emission control driver comprises a plurality of stage circuits connected to the plurality of emission control lines, and each of the plurality of stage circuits comprises:

a first transistor connected between a third input terminal and a first node, and comprising a gate electrode connected to a first input terminal;

a second transistor connected between a second node and the first input terminal, and comprising a gate electrode connected to the first node;

a third transistor connected between the second node and a second voltage terminal, and comprising a gate electrode connected to the first input terminal;

a fourth transistor connected between the first node and a third node, and comprising a gate electrode connected to a second input terminal;

a fifth transistor connected between a first voltage terminal and the third node, comprising a gate electrode connected to the second node;

a sixth transistor connected between a fourth node and the second input terminal, and comprising a gate electrode connected to the second node;

a seventh transistor connected between the fourth node and a fifth node, and comprising a gate electrode connected to the second input terminal;

an eighth transistor connected between the first voltage terminal and the fifth node, and comprising a gate electrode connected to the first node;

a ninth transistor connected between the first voltage terminal and an output terminal, and comprising a gate electrode connected to the fifth node; and a tenth transistor connected between the output terminal and the second voltage terminal, and comprising a gate electrode connected to the first node.

22. The organic light emitting display device as claimed in claim 21, wherein each of the plurality of stage circuits further comprises:

a first capacitor connected between the first node and the second input terminal;

a second capacitor connected between the second node and the fourth node; and a third capacitor connected between the first voltage terminal and the fifth node.

23. The organic light emitting display device as claimed in claim 22, wherein a third input terminal of a first stage circuit of the plurality of stage circuits receives an initial signal from the timing controller, and a third input terminal of a Kth stage circuit of the plurality of stage circuits is connected to an output terminal of a K−1th stage circuit, wherein K is a natural number of 2 or above.

24. The organic light emitting display device as claimed in claim 23, wherein a first input terminal and a second input terminal of each of odd-numbered stage circuits of the plurality of stage circuits receive the first emission driving signal and the second emission driving signal, respectively, and a first input terminal and a second input terminal of each of even-numbered stage circuits of the plurality of stage circuits receive the second emission driving signal and the first emission driving signal, respectively.

25. A method for driving an organic light emitting display device, the method comprising:

performing a first driving mode that involves displaying an image on a display panel that comprises a plurality of pixels in a first frame frequency; and performing a second driving mode that involves displaying an image on the display panel in a second frame frequency that is lower than the first frame frequency, wherein at the performing the first driving mode and at the performing the second driving mode, the plurality of pixels are supplied with a first pixel voltage and a second pixel voltage, wherein at least one level of the first pixel voltage and the second pixel voltage is adjusted by a power supply such that a voltage difference between the first pixel voltage and the second pixel voltage during the second driving mode is smaller than a voltage difference between the first pixel voltage and the second pixel voltage during the first driving mode, and wherein the first pixel voltage during the second driving mode is set to a lower voltage level than during the first driving mode, and the second pixel voltage during the second driving mode is set to a higher voltage level than during the first driving mode.

26. The method as claimed in claim 25, wherein at the performing the first driving mode, the plurality of pixels are supplied with scan signals and data signals at every frame period; and at the performing the second driving mode, the plurality of pixels are supplied with the scan signals and the data signals during a portion of a frame period, and are not supplied with the scan signals and the data signals during remaining frame periods.

27. The method as claimed in claim 26, wherein the plurality of pixels comprise an organic light emitting diode and a driving transistor connected between a first pixel power line for receiving the first pixel voltage and a second pixel power line for receiving the second pixel voltage, respectively, and the driving transistor operates in a saturation region during the first driving mode, and operates in a linear region during the second driving mode.

28. The method as claimed in claim 25, wherein the power supply supplies a first driving voltage and a second driving voltage to a scan driver, wherein the power supply adjusts at least one level of the first driving voltage and the second driving voltage such that a voltage difference between the first driving voltage and the second driving voltage during the second driving mode is smaller than a voltage difference between the first driving voltage and the second driving voltage during the first driving mode, and wherein the first driving voltage during the second driving mode is set to a lower voltage level than during the first driving mode, and the second driving voltage during the second driving mode is set to a higher voltage level than during the first driving mode.

* * * * *